United States Patent [19]

Amaya et al.

[11] 4,079,600

[45] Mar. 21, 1978

[54] METHOD AND APPARATUS FOR DOFFING FABRIC ROLLS FROM A CIRCULAR KNITTING MACHINE

[75] Inventors: Yukio Amaya, Obu; Hirohisa Suzuki, Toyoda; Munechika Inoue, Kariya, all of Japan

[73] Assignee: Kabushiki Kaisha Toyoda Jidoshokki Seisakusho, Japan

[21] Appl. No.: 688,242

[22] Filed: May 20, 1976

[30] Foreign Application Priority Data

May 24, 1975 Japan ..... 50-62104
May 28, 1975 Japan ..... 50-63632

[51] Int. Cl.[2] ..... D04B 15/99; D04B 35/34; D04B 15/88

[52] U.S. Cl. ..... 66/56; 66/147; 66/151; 66/157

[58] Field of Search ..... 66/56, 147, 151

[56] References Cited

U.S. PATENT DOCUMENTS

| | | | |
|---|---|---|---|
| 2,864,248 | 12/1958 | Wiesinger | 66/56 |
| 3,472,048 | 10/1969 | Shaw | 66/151 X |
| 3,839,885 | 10/1974 | Bourgeois | 66/151 |
| 3,850,012 | 11/1974 | Bourgeois | 66/151 |
| 3,872,692 | 3/1975 | Miyagawa et al. | 66/151 |
| 3,985,001 | 10/1976 | Eschenbach | 66/151 X |

FOREIGN PATENT DOCUMENTS

| | | | |
|---|---|---|---|
| 2,005,141 | 8/1971 | Germany | 66/151 |

OTHER PUBLICATIONS

Strasser, *Textile Institute and Industry*, vol. 8, No. 12, Dec. 1970, pp. 337-340.

*Primary Examiner*—Wm. Carter Reynolds
*Attorney, Agent, or Firm*—Burgess, Ryan and Wayne

[57] ABSTRACT

Method and apparatus for doffing fabric rolls formed on a winding shaft from a circular knitting machine. When the knitting machine is stopped after a predetermined length of knitted fabric is wound on a winding shaft, the angular position of the winding shaft with respect to the common rotational center of the knitting device and the winding mechanism is controlled by means of a particular mechanism so that the winding shaft occupies a predetermined angular position. Then the knitted fabric is cut at a position adjacent to the winding shaft. Thereafter, both ends of said winding shaft, whereon a full size fabric roll is formed, are simultaneously released from the supporting members of the winding mechanism and the fabric roll doffed from the winding mechanism is received by a receiving plate of a truck positioned at its standby position right below the winding mechanism. Thereafter, the full size fabric roll is transported to a position outside the knitting machine by moving the truck from the above-mentioned standby position to a position outside the knitting machine.

17 Claims, 35 Drawing Figures

XX
XXI
131
132
134a
134b
135
136
137
138
138A
138a
139
140
141
142
142a
94a
94b
8

METHOD AND APPARATUS FOR DOFFING FABRIC ROLLS FROM A CIRCULAR KNITTING MACHINE

SUMMARY OF THE INVENTION

The present invention relates to a method and apparatus for doffing fabric rolls from a circular knitting machine.

In a circular knitting machine according to the prior art, a tubular knitted fabric produced is wound flat onto a rotatable winding shaft of a winding mechanism disposed at a position below a knitting mechanism of the machine. When a predetermined length of the knitted fabric is wound on the winding shaft, an operator first cuts the knitted fabric at a position between the knitting mechanism of the machine and the roll of knitted fabric formed on the winding shaft and, then, the roll of knitted fabric is doffed from the winding mechanism together with the winding shaft manually. Consequently in the knitting operation of the conventional circular knitting machine, the doffing operation is complicated and requires heavy labor of the operator.

In U.S. Pat. No. 3,839,885, a mechanism for removing the rolls of knitted fabric from the circular knitting machine is disclosed. In this mechanism, the winding mechanism is provided with a rotatable winding shaft supported at its two ends by bearings and one of the bearings can be moved to the free end of the winding shaft. This one movable bearing forms part of a receiving drawer for a cut-off roll of fabric. The drawer is capable of sliding axially on the shaft to remove the fabric roll from the shaft and outside of the frame of the machine. When a predetermined length of the knitted fabric is wound on the winding shaft, the knitted fabric is cut by a cutter mounted on the knitting machine at a position between the knitting mechanism and the winding shaft. Next, one end of the winding shaft is freed from the bearing mounted on the receiving drawer by the axial movement of the receiving drawer, so that the winding shaft is then supported by the other bearing which is stationarily disposed at a side of a driving mechanism. The fabric roll is taken from the winding shaft by pushing a side thereof according to the further axial displacement of the receiving drawer. The fabric roll taken from the winding shaft is disposed on a bottom portion of the receiving drawer. As mentioned above, the winding shaft is supported its one end by the stationary bearing during the removing operation of the fabric roll therefrom and, consequently, it is inevitable that a very complicated mechanism must be used to support the winding shaft. Further, when the one end of the winding shaft is supported by the stationary bearing, since the winding shaft tends to bend somewhat, it is difficult to smoothly slide the fabric roll toward the free end of the winding shaft. Consequently, it is essential to push a side of the fabric roll by a sufficiently strong force to axially slide the fabric roll along with winding shaft. Therefore, there is the possibility of breaking the stationary bearing, the connection of the winding shaft with the driving mechanism or the winding shaft itself.

In view of the problems involved with the above-mentioned mechanism for removing the fabric rolls from the circular knitting machine disclosed in U.S. Pat. No. 3,839,885, it may be thought that it would be better to convert the above-mentioned manual doffing operation to a simple mechanical operation. However, if such a mechanical doffing operation is employed, many complicated problems have to be solved. That is, problems concerning how to smoothly remove the winding shaft provided with a fabric roll from the winding mechanism and how to transfer the fabric roll of heavy weight outside the knitting machine, must be practically solved. According to the inventors' preliminary experimental research, it was found that the winding shaft must be removed from the winding device while maintaining the horizontal condition of the winding shaft. This is because, if the winding shaft is positioned in a somewhat inclined condition during the removing operation thereof from the winding device, smooth removing of the winding shaft from the winding device can not be expected. In addition, if the winding shaft is removed from the supporting means of the winding device in an inclined condition and a transferring means is utilized for transferring the doffed fabric roll outside the knitting machine, the possibilities exist that only an end portion of the winding shaft will be received by the transferring means or the fabric roll formed on the winding shaft will roll off of the transferring means. If either of these possibilities occur, at the very least the transferring means can not work correctly and, even more serious, the transferring means might be broken.

The object of the present invention is to provide an automatic method for doffing fabric rolls from the conventional circular knitting machine, wherein the above-mentioned problems can be solved.

The other object of the present invention is to provide a practical mechanism for carrying out the above-mentioned automatic method according to the present invention.

To attain the purpose of the present invention, fabric rolls are removed from the winding mechanism disposed below the knitting device of the circular knitting machine by means of a transferring means which is independently disposed from the knitting mechanism and the winding mechanism at a position adjacent to the winding mechanism. Each fabric roll formed on a winding shaft is removed together with the winding shaft from the winding device of the knitting machine. When the knitting machine is stopped after a predetermined length of the knitted fabric is wound on the winding shaft, the angular position of the winding shaft with respect to the common rotational center of the knitting device and the winding device is controlled by means of a particular mechanism, so that the winding shaft occupies a predetermined angular position. After the winding shaft is stopped at the predetermined angular position, the knitted fabric is cut at a position adjacent to the winding shaft. Then, both ends of the winding shaft are simultaneously removed from engagement with the supporting means of the winding mechanism, so that the fabric roll is received by the transferring means smoothly and rapidly. After completion of the above-mentioned transfer of the fabric roll from the winding mechanism of the circular knitting machine, a fresh winding shaft is mounted on the winding mechanism and a free cut end of the knitted fabric coming from the knitting device is automatically fixed on the fresh winding shaft mounted on the winding device. Then, the knitting operation of the circular knitting machine is once again commenced.

The mechanism for carrying out the above-mentioned method, is provided with: a control means for stopping the knitting device and the winding device at a predetermined angular position thereof; means for cutting the knitted fabric along the winding shaft;

means for simultaneously removing both ends of a winding shaft from engagement with the supporting mechanism of the winding mechanism; transferring means for receiving the fabric rolls from the winding device and transferring the fabric rolls outside the circular knitting machine. This mechanism is additionally provided with: means for supplying a fresh winding shaft to the winding mechanism; means for automatically fixing a cut end of the knitted fabric on the fresh winding shaft mounted on the winding device, and; a programming control mechanism for stepwisely operating the above-mentioned mechanisms.

For the sake of a better understanding of the present invention, a circular knitting machine provided with a mechanism for removing fabric rolls therefrom is firstly explained, with reference to FIGS. 1, 2, 3, 4 and 5.

Figure 5:
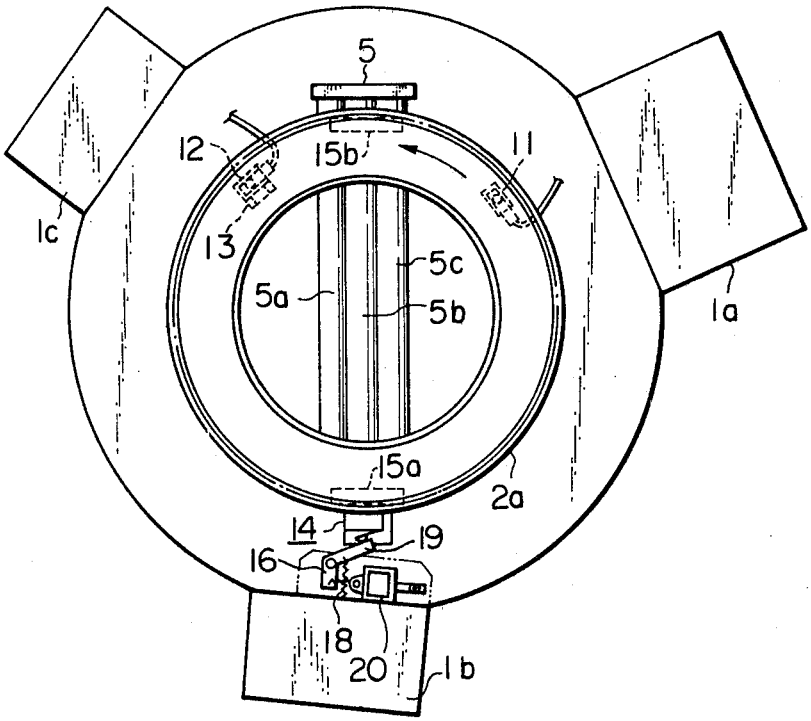
FIG. 5 is a schematic plan view of the upper supporting gear of the circular knitting machine shown in FIG. 1 and related mechanism thereof.

Ring shaft supporting gears 2*a*, 2*b* are supported by three box frames 1*a*, 1*b* and 1*c*, at the upper and intermediate portions of the box frames in such a condition that these gears 2*a* and 2*b* are capable of rotating in the direction indicated by an arrow in FIG. 5. Each box frame 1*a*, 1*b* and 1*c* is provided with a driving device and a lubrication device, and the gears 2*a*, 2*b* are driven by the above-mentioned driving device disposed in each box frame 1*a*, 1*b* and 1*c*.

A knitting device 3 is rigidly mounted on the upper part of the upper supporting gear 2*a* so that the knitting device 3 is capable of turning integrally with the gear 2*a*. A yarn feed mechanism is mounted on an attachment frame 4 disposed to a machine frame at a position above the box frame 1*a*, 1*b* and 1*c*. A takeup device 5, which is comprised of three takeup rollers 5*a*, 5*b* and 5*c* arranged parallel to one another, is disposed at a position below the lower supporting gear 2*b* and rigidly supported thereby. A winding device 7 is disposed at a position below the above-mentioned takeup device 5 in such a condition that the winding device 7 is rigidly supported by and capable of rotating integrally with the supporting gear 2*b*, and with an automatic device for exchanging a winding shaft 8, whereupon a predetermined length of the knitted fabric has been wound, for a fresh winding shaft.

In the above-mentioned circular knitting machine, when a tubular knitted fabric 6 is formed by the yarn fed by the above-mentioned yarn feeding mechanism the tubular knitted fabric 6 is taken up by the takeup device 5 and then wound on a winding shaft 8 of the winding device 7. When it is detected that a predetermined length of the knitted fabric has been wound on the winding shaft 8, the driving of the circular knitting machine is stopped and the fabric roll formed on the winding shaft 8 of the winding device is doffed from the winding device together with the winding shaft by means of an automatic doffing device and discharged outside the circular knitting machine.

The automatic apparatus for removing a fabric roll formed on a winding shaft 8 of the winding device according to the present invention comprises: means for detecting such a condition that a predetermined length of the knitted fabric 6 has been wound on a winding shaft of the winding device 7, and for stopping the winding shaft at a predetermined angular position thereof, together with the knitting device 3 and the winding device 7, with respect to a vertical turning center thereof when the above-mentioned predetermined winding condition is detected, a cutting mechanism for automatically cutting the knitted fabric 6 at a position between the knitting device 3 and the winding shaft mounted on the winding device 7; means for supporting a winding shaft in such a condition that said supporting means is capable of simultaneously releasing both ends of said winding shaft after said knitted fabric 6 is cut by said cutting mechanism, and; means for receiving a fabric roll formed on a winding shaft when the supporting means simultaneously releases both ends of the winding shaft and for transferring the received fabric roll outside the circular knitting machine. The above-mentioned automatic apparatus for removing fabric rolls is hereinafter referred to as an automatic fabric roll doffing device.

The circular knitting machine provided with the automatic fabric roll doffing device according to the present invention is preferably provided with such auxiliary devices as an automatic device for supplying a fresh winding shaft 8; an automatic device for mounting a fresh winding shaft 8, supplied from the supply device on the winding device 7, and; means for automatically fixing a free edge of the knitted fabric coming from the knitting device 3, by way of the takeup device 5, on the fresh winding shaft mounted on the winding device 7.

The detailed construction and function of the above-mentioned component elements of the automatic doffing device and auxiliary devices according to the present invention is hereinafter explained in detail.

MECHANISM FOR STOPPING THE WINDING SHAFT TOGETHER WITH THE KNITTING DEVICE AND TAKEUP AND WINDING DEVICES.

Figure 6:
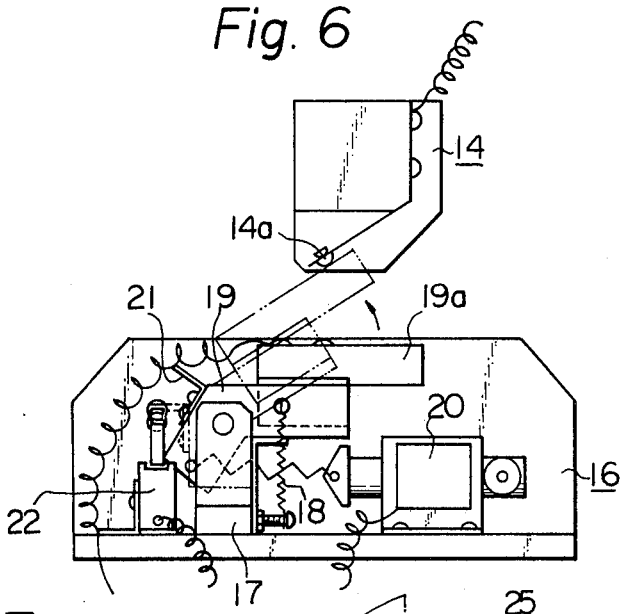
FIG. 6 is a schematic side view of a current collector utilized for the circular knitting machine shown in FIG. 1.

As shown in FIGS. 5 and 6, a first limit switch 11, which issues a signal indicating one revolution of the knitting device 33 which rotates together with the takeup device 5 and the winding device 7, and a second limit switch 12, which issues a signal for stopping the knitting device 3 as well as the takeup device 5 and the winding device 7 at a predetermined common angular position, are disposed at positions below the supporting gear 2a. The limit switch 11 is connected to an automatic counter (not shown) which measures the length of the knitted fabric 6 wound on the winding shaft 8. A conventional digital counter can be used as the above-mentioned automatic counter, and when the limit switch issues a signal indicating one revolution of the upper supporting gear 2a, the automatic counter counts one; and when the automatic counter counts a predetermined number of revolutions of the upper supporting gear 2a, the automatic counter issues a signal by which a speed control device (not shown) is actuated so as to reduce the driving speed of the entire circular knitting machine. Since a digital counter having a construction similar to the counter used for conventional textile machines can be used for the present invention, and it is well-known that a stop motion of these textile machineries is actuated by the signal issued from the digital counter, the detailed explanation thereof is omitted. That is, when the automatic counter issues a predetermined full count, which indicates that a predetermined length of the knitted fabric 6 has been wound on the winding shaft 8, the driving speed control device is actuated so as to reduce the driving speed of entire knitting machine. These limit switches 11 and 12 are arranged with an intervening angular space as shown in FIG. 5. The upper supporting gear 2a is provided with a dog 13 at a position on the under-surface thereof where the dog 13 is capable of actuating the above-mentioned limit switches 11 and 12. After a predetermined time of driving speed reduction of the entire knitting machine, the second limit switch 12 is actuated by the dog 13 so as to stop the knitting device 3, takeup device 5 and the winding device 7 at their common axial position which is predetermined. The above-mentioned predetermined time is selected to be such that the dog 13 is capable of actuating the second limit switch 12 after the driving speed of entire knitting machine is sufficiently reduced. In a modification of this embodiment, the proper reduced driving speed of the knitting machine is predetermined and, when this proper reduced driving speed is reached, the dog 13 is actuated so as to actuate the second limit switch 12 by means of a speed measuring device (not shown). In another modification of this embodiment, before actuating the second limit switch 12, the entire knitting machine is stopped and then is driven at a very slow driving speed for a predetermined time, thereafter the second limit switch 12 is actuated. In an alternate modification, a set of dogs are disposed on the supporting gear 2b in such a condition that one of dogs actuates the first limit switch 11 while the other dog actuates the second limit switch 12.

Figure 3:
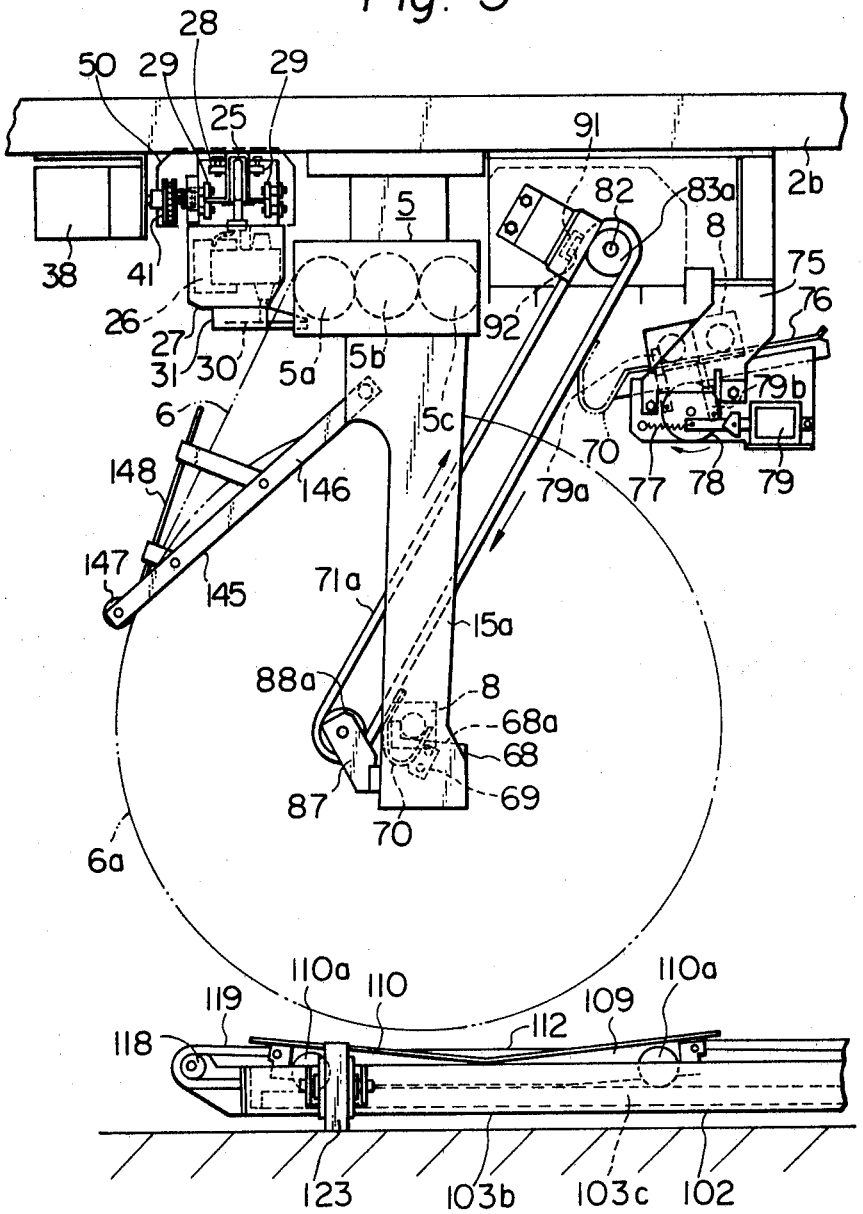
FIG. 3 is a schematic side view of a takeup mechanism and a winding mechanism, a part of a fresh winding shaft feeding mechanism, and also a transferring mechanism utilized for the circular knitting machine shown in FIG. 1.
Figure 4:
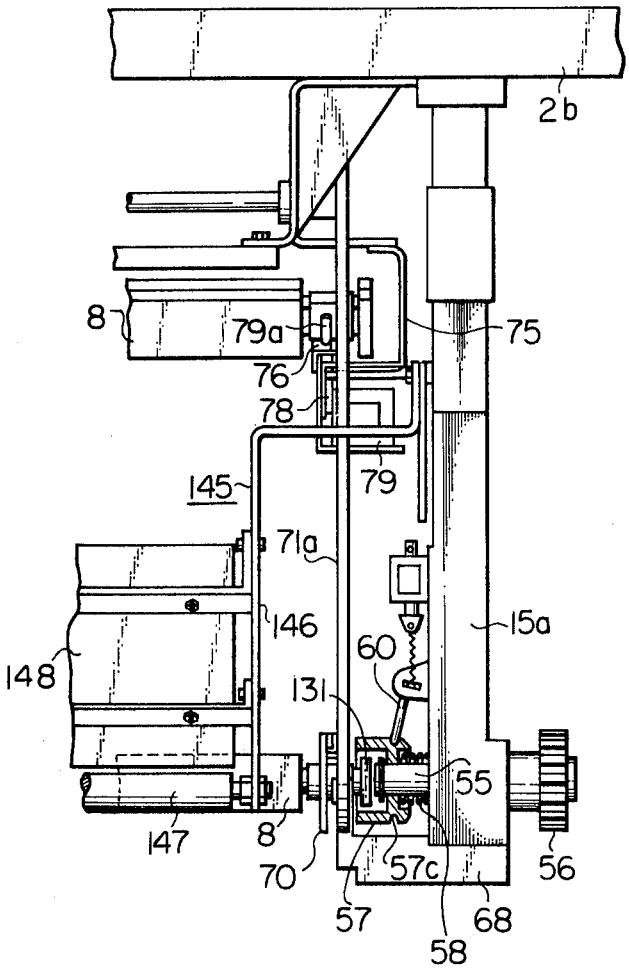
FIG. 4 is a schematic front view of a part of the winding mechanism and the fresh winding shaft feeding mechanism shown in FIG. 3.

As illustrated in FIGS. 3 through 5, shaft supporting frames 15a and 15b are mounted on the lower face of the lower supporting gear 2b at positions corresponding to both ends of the takeup rollers 5a, 5b and 5c so as to support the two ends of the winding shaft 8. A current collector 14 is mounted at a suitable position of the shaft supporting frame 15a for collecting current supplied from an electric source so as to drive such mechanisms as the automatic cutting device etc. which are rotated together with the winding device 7 about the common rotation center.

An electricity feeder 16 is disposed on the box frame 1b at a position corresponding to the position of the current collector 14 when the knitting machine is stopped. As shown in FIGS. 5 and 6, this electricity feeder 16 comprises: an engaging lever 19, which is rotatably supported by a bracket 17 secured to the box frame 1b and is always urged toward a retracting direction (the direction opposite to the direction indicated by an arrow in FIG. 6) by a spring 18; an electromagnetic solenoid 20 disposed to actuate the engaging lever 19 so that the lever 19 is projected into the moving locus of the current collector 14, so that a contact 19a formed at the free end of the engaging lever 19 is capable of contacting a contact 14a of the current collector 14, and; a switch 22, for confirmation of the projection of the engaging lever 19, which is arranged in such a way that when the engaging lever 19 projects into the moving locus of the current collector 14, the switch 22 is actuated by an engaging piece 21 attached to the base of the engaging lever 19.

In the above-mentioned arrangement, when the rotation speed of the knitting device 3 and the winding device 7 about the common rotational center is reduced to the proper speed by the operation of the first limit switch 11, the engaging lever 19 of the electricity feeder 16 is projected into the moving locus of the current collector 14, against the retracting force of the spring 18, by the electromagnetic solenoid 20 prior to stoppage of the knitting device 3 and the winding device 7 by the action of the second limit switch 12. At this moment, the switch 22 is actuated by the engaging piece 21, attached to the base of the engaging lever 19, whereby projection of the engaging lever 19 is confirmed. Then, when the knitting device 3 and the winding device 7 arrive at the predetermined common angular stop position, the dog 13 actuates the second limit switch 12 so as to stop the motion of the knitting device together with the winding device 7. When the contact 14*a* of the current collector 14 falls in contact with the engaging lever contact 19*a* of the electricity feeder 16 which has already projected in a manner as described above, feeding of electricity is started.

Various modifications may be adopted for projection of the engaging lever 19 and feeding of electricity. For example, it is possible to adopt an arrangement in which after the rotational speeds of the knitting device 3 and the winding device 7 have been reduced, they are stopped at the predetermined common angular position by actuation of the second limit 12 and at the same time, the electromagnetic solenoid 20 of the electricity feeder 16 is actuated to project the engaging lever 19 into contact with the contact 14*a* of the current collector 14 stopped at the position corresponding to the projection point of the engaging lever 19 so as to start feeding electricity. Further, there may be adopted an arrangement in which the feeding of electricity is started a certain time after the engaging lever 19 of the electricity feeder 16 falls into contact with the contact 14*a* of the current collector 14.

AUTOMATIC DEVICE FOR CUTTING THE KNITTED FABRIC

A preferable embodiment of the device for automatically cutting the knitted fabric in the circular knitting machine is hereinafter explained in detail with reference to FIGS. 7 through 12.

A guide rail 25 is secured to the lower face of the supporting gear 2*b* in parallel to the takeup rollers 5*a*, 5*b*, 5*c* of the takeup device 5. The guide rail 25 is provided with a longitudinal rail 25*a*, having a substantially reverse U-shaped section, and a pair of laterally projected rails 25*b*, which are formed by bending the lower end portions of the longitudinal rail 25*a*, respectively.

A carrier 28 provided with a container case 27, for receiving a motor 26 in the lower portion thereof, is supported on the guide rail 25 by a plurality of rollers 29 pivoted in the interior of the carrier 28. The rollers 29 are capable of rolling on both side faces of the longitudinal rail 25*a* of the guide rail 25 and the top and bottom faces of the laterally projected rails 25*b* of the guide rail 25. The rollers 29 can roll back and forth in the longitudinal direction of the guide rail 25.

Figure 9:
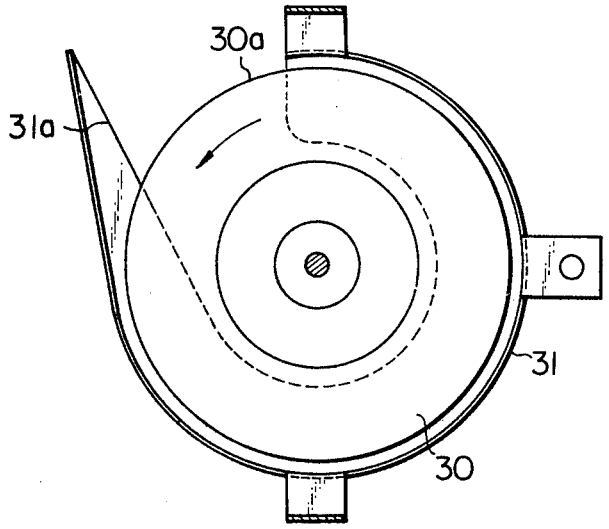
FIG. 9 is a plan view of a cover utilized for covering the cutter shown in FIG. 7.

A disc-like cutter 30 is fixed to the end of a driving shaft of the motor 26, which is projected downwardly below the container case 27. A cutter cover 31 is attached to the lower face of the container case 27 to cover the cutter 30. At a part of the cutter cover 31, as shown in FIG. 9, a guide 31*a* is formed to extend so that a V-shaped space is formed between the guide 31*a* and a blade 30*a* of the cutter 30, whereby the knitted fabric 6 can be cut assuredly and easily by the cutter 30.

Figure 8:
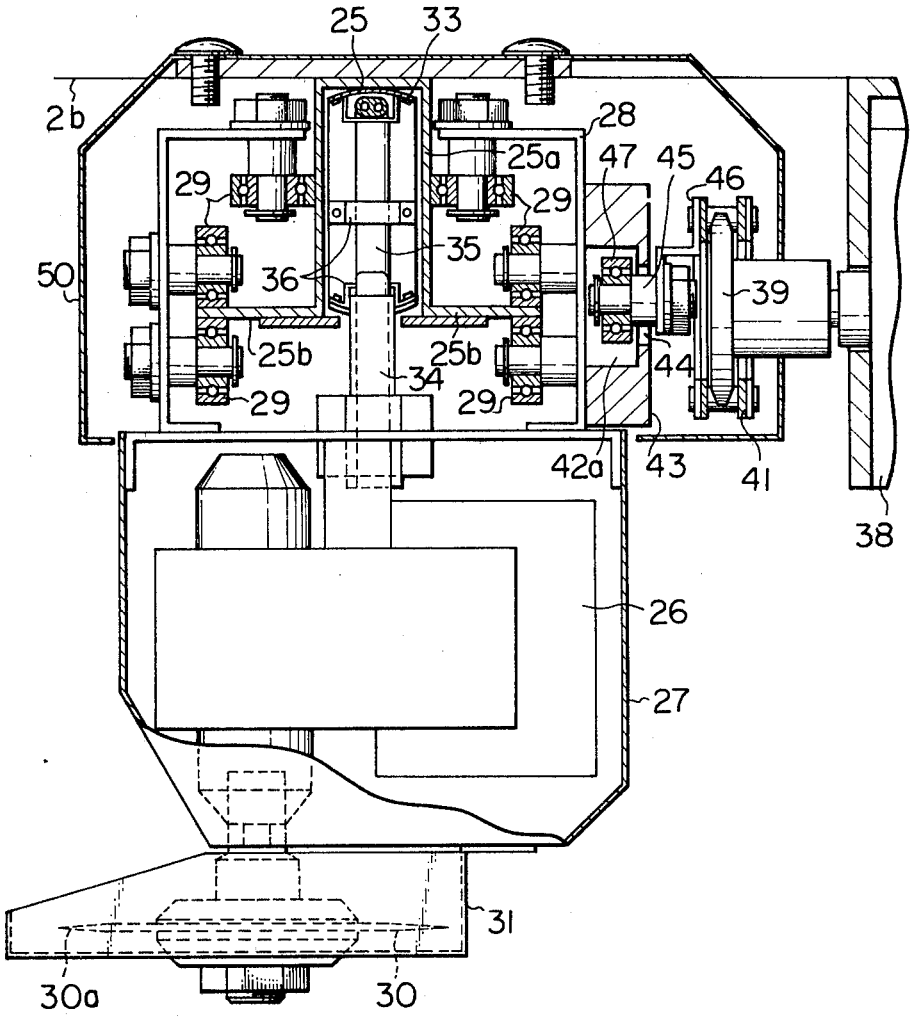
FIG. 8 is a side view of a carrier for displacing a cutter of the automatic cutting device shown in FIG. 7.
Figure 10:
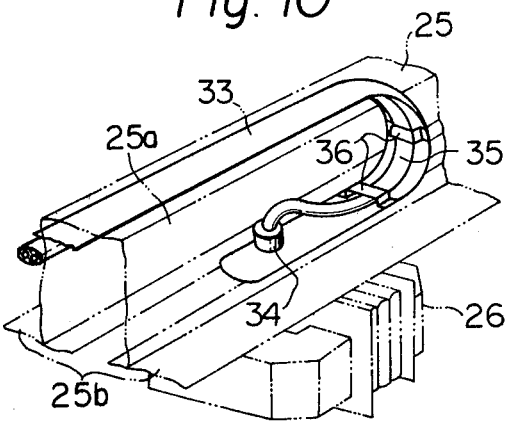
FIG. 10 is a perspective view of the arrangement of a power cord in the automatic cutting device shown in FIG. 7, FIGS. 11A and 11B are side views of a supporting belt of the carrier shown in FIG. 7.
Figure 11A:
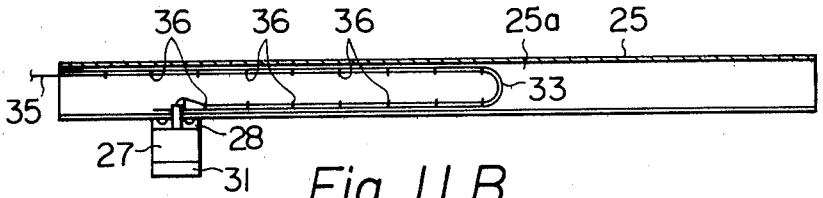
Figure 11B:
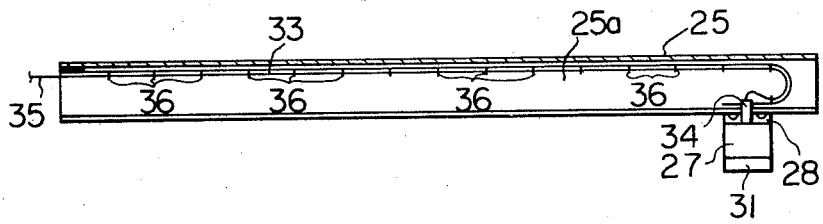

As shown in FIGS. 8, 10 and 11, a supporting belt 33 composed of a long steel band, which has a base end fixed to one side end of the inner top face of the longitudinal rail 25*a* of the guide rail 25 and is slightly curved in the lateral direction, is folded back inside the longitudinal rail 25*a* of the guide rail 25. The top end of the supporting belt 33 is fixed to the top end of a cord introduction cylinder 34 projected from the container case 27. A power cord 35 of the motor 26 is disposed in the longitudinal rail 25*a* of the guide rail 25 and is attached to the curved inner face of the supporting belt 33 by a plurality of attachment members 36. The top end of the power cord 35 is introduced into the container case 27 by way of the cord introduction cylinder 34 and is then connected to the motor 26.

A driving sprocket wheel 39 is rigidly mounted on the end of a driving shaft of a motor 38 disposed in the vicinity of one end of the guide rail 25 on the lower face of the supporting gear 2*b*. A driven sprocket wheel 40 is attached to the other end of the guide rail 25. A chain 41 is mounted on the driven sprocket wheel 40 and the driving sprocket wheel 39 in parallel with the guide rail 25.

Figure 12:
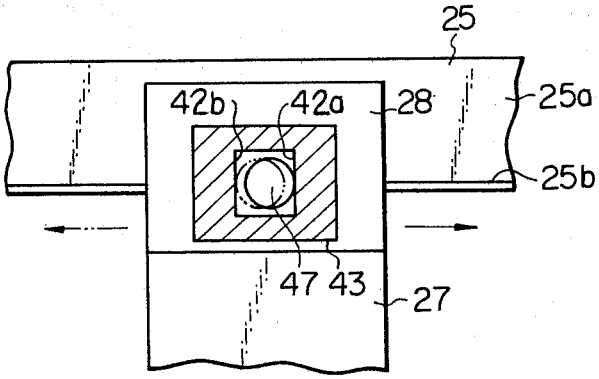
FIG. 12 is a schematic front view of the relation between the carrier and the guide rail of the automatic cutting device shown in FIG. 7, FIGS. 13A and 13B are perspective views of a winding shaft supporting mechanism of the winding mechanism utilized for the circular knitting machine shown in FIG. 1, FIGS. 14A and 14B are perspective views of a bearing member of the winding shaft supporting mechanism shown in FIGS. 13A and 13B.

As illustrated in FIGS. 8 and 12, a roller case 43 having both left and right inner side faces, which form pressing faces 42*b* and 42*a* (respectively the face 42*a* is shown in FIG. 8) is disposed substantially at the center of the side face of the carrier 28 confronting the chain 41. An aperture 44 is formed at the center of the side wall of the case 43. A connecting shaft 45 is inserted into the aperture 44 of the roller case 43 and the base end of a connecting piece 46 is attached to the outer end of the connecting shaft 45 while the top end of the connecting piece 46 is secured to a suitable position on the chain 41. A pressing roller 47 is rotatably attached to the inner end of the connecting shaft 45 so that the pressing roller 47 presses the pressing inner face 42*a* or 42*b* of the roller case 43 so as to be able to reciprocate the carrier 28 along the guide rail 25.

Figure 7:
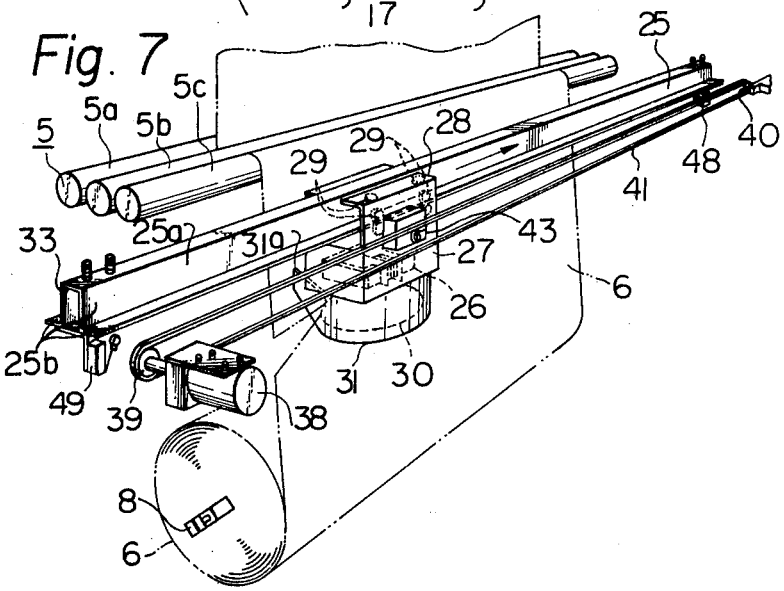
FIG. 7 is a schematic perspective view of an automatic device for cutting the knitted fabric applied for the circular knitting machine shown in FIG. 1.

As shown in FIG. 7, a third limit switch 48 for stopping the motor 26 which drives the cutter 30 and a fourth limit switch 49 for stopping the motor 38, which drives the carrier 28, are attached to the lower parts of both the ends of the guide rail 25, respectively. A fixed cover 50 is attached to an upper part of the guide rail 25 so that it covers the entire guide rail 25 and chain 41 from above and from both sides.

Referring to FIGS. 1, 5, 7 and 12, when the knitting device 3 and the winding device 7 are stopped and the current collector 14 contacts the engaging lever 19, the motor 38 is started so as to rotate the chain 41, and also the motor 26 is started so as to rotate the cutter 30. At this moment, as indicated by solid lines in FIG. 12, the pressing inner face 42*a* of the roller case 43 is pressed by the pressing roller 47 to move the carrier 28 at the stand-by position along the guide rail 25 in a direction indicated by an arrow in FIG. 7. The knitted fabric 6 is cut by the cutter 30 between the takeup mechanism 5 and the winding shaft 8 in such a manner that the knitted fabric 6 is cut along the guide rail 25 toward the direction indicated by an arrow in FIG. 7.

Then, the carrier 28 is further displaced along the guide rail 25 in the direction indicated by an arrow in FIG. 7 and when it is engaged with the limit switch 48 (FIG. 7), the limit switch 48 issues a signal to stop the motor 26, whereby the rotation of the cutter 30 is stopped. However, since the chain 41 is still rotated by the motor 38, the chain-attaching position of the connecting piece 46 which connects the chain 41 to the carrier 28, is reversed at the point of the driven sprocket wheel 40 and, hence, the chain 41 is moved in a direction reverse to the direction of the arrow in FIG. 7. At this point, as indicated by a two-dot chain line in FIG. 12, the other pressing inner face **42*b* of the roller case 43 is pressed to the pressing roller 47 to move the carrier 28 along the guide rail 25 toward the stand-by position (in the direction reverse to the direction of the arrow in FIG. 7). When the carrier 28 arrives at the stand-by position of the guide rail 25 and is engaged with the limit switch 49, the switch 49 is actuated to stop the motor 38, whereby the carrier 28** is stopped at the stand-by position.

In this embodiment, since the cutter 30 is covered by the cutter cover 31, the operation can be performed with safety. Further, since the guide **31*a* is formed at a part of the cover 31 to extend so that a V-shaped space is formed between the guide 31*a* and the balde 30*a* of the cutter 30, with movement of the carrier 28 the knitted fabric 6 is assuredly introduced to the blade 30*a* of the cutter 30 so that the knitted fabric 6 is cut by the blade 30*a***.

WINDING SHAFT HOLDING MECHANISM

The winding shaft holding mechanism for rotatably holding the winding shaft 8 at the winding position and releasing a fully wound winding shaft 8, and letting it fall in response to completion of cutting of the knitted fabric 6 will now be described by referring especially to FIGS. 13A, 13B, 14A and 14B.

A rotary shaft 55 is rotatably supported substantially at the center thereof by the lower end of the shaft supporting frame **15*a*. A ratchet wheel 56 which is intermittently rotated by a known intermittent feed mechanism (not shown) is fixed to the outer end of the rotary shaft 55 to rotate the rotary shaft 55 intermittently. A substantially cylindrical bearing member 57 is keyed to the inner end of the rotary shaft 55 so that it can move in the axial direction of the rotary shaft 55. The bearing member 57 is always urged to the shaft supporting direction (the direction indicated by an arrow in FIG. 13A) by a spring 58. Four supporting pieces 57*a* are equidistantly projected on the inner end of the bearing member 57. In each of these supporting pieces 57*a*, the inner side face is made flat so that a fitting member 54, of a square shape and fixed to one end of a central shaft 8*a* of the winding shaft 8, is fitted into the space between said inner side faces. The outer end of the bearing member 57 is formed so as to have a conical shape in which the diameter is decreased toward the tip portion thereof, so that a switch 59 for confirmation of releasing of the winding shaft 8 is actuated by an inclined surface 57*b* of the bearing member 57. A engaging groove 57*c* is formed along the entire circumference of the bearing member 57 substantially at the central portion of the circumferencial surface thereof, and the lower end of an operation lever 60, turnably supported on the upper portion of the bearing member 57, is always engaged with the engaging proove 57*c***.

An electromagnetic solenoid 61 is disposed to the inside face of the shaft supporting frame **15*a* above the operation lever 60. When the solenoid 61 is excited, the bearing member 57 is displaced against the force of the spring 58 toward a direction of releasing the winding shaft 8 (the direction reverse to the direction of the arrow in FIG. 13A) by way of the operation lever 60**.

Figure 13A:
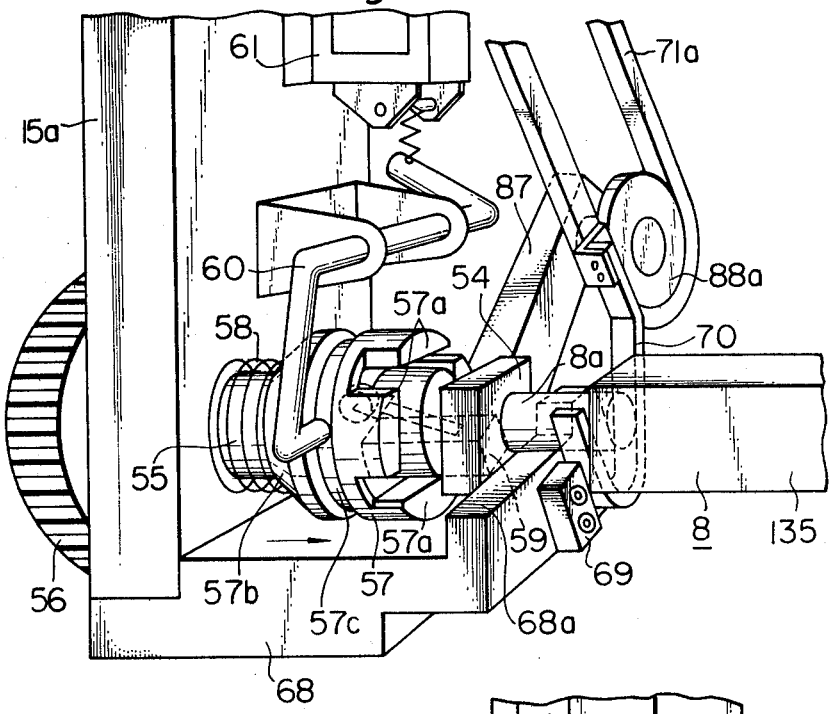
Figure 13B:
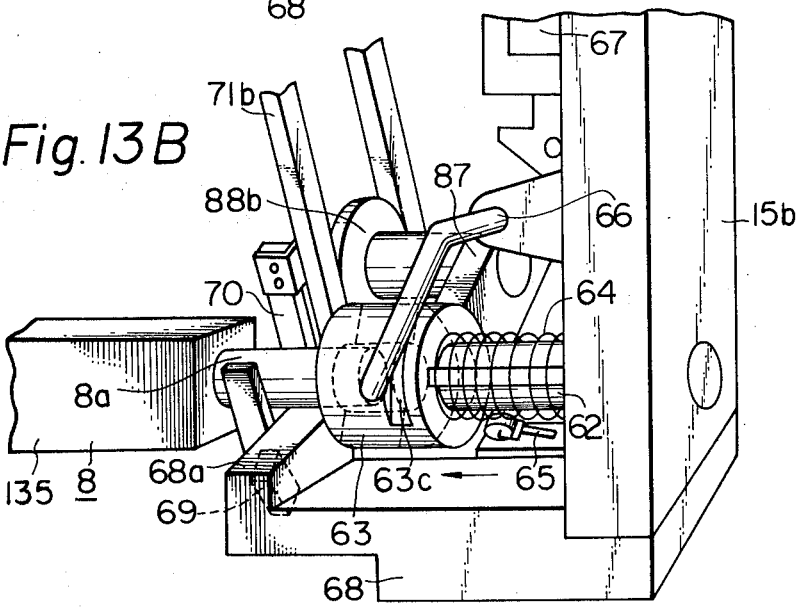

As shown in FIG. 13B, a shaft 62 is fixed on the lower end of the other shaft supporting frame **15*b* at a position corresponding to that of the rotary shaft 55 in such a way that the shaft 62 projects inwardly. A substantially cylindrical bearing member 63 is keyed onto the shaft 62 so that it is capable of moving in the axial direction of the shaft 62. The bearing member 63 is always urged toward the shaft supporting direction (the direction indicated by an arrow in FIG. 13B) by a spring 64**.

Figure 14A:
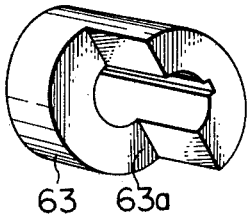
Figure 14B:
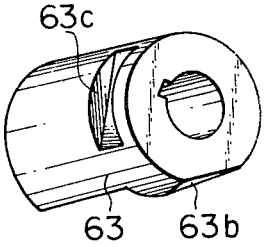

A semi-cylindrical notched portion **63*a* is formed on the inner end of the bearing member 63 so that it extends almost to the central position as shown in FIG. 14A. An engaging face 63*b*, having an inclined end, is formed at a suitable position of the outer peripheral edge of the bearing member 63, as shown in FIG. 14B, to actuate a fifth limit switch 65 for confirmation of release of the winding shaft 8. On the circumferential surface of the bearing member 63, an engaging groove 63*c* is formed at a position adjacent to the outer end as shown in FIG. 14B. The lower end of an operation lever 66, rotatably supported on the upper portion of the bearing member 63, is always engaged with the engaging groove 63*c***.

On the inside face of the shaft supporting frame **15*b*, an electromagnetic solenoid 67 is disposed above the operation lever 66. When the solenoid 63 is excited together with the above-mentioned electromagnetic solenoid 61, the bearing member 63 is moved against the force of the spring 64 toward a direction of releasing the winding shaft 8 (the direction reverse to the direction of the arrow in FIG. 13B) through the operation lever 66**.

A pair of supporting members 68 are fixed to the lower ends of the shaft supporting frames **15*a* and 15*b*, respectively. An inclined guide face 68*a* is formed on the upper portion of the inner end of each supporting member 68 to turn the winding shaft 8 and guide it to the fall-out position. Regulating members 69 are attached to the confronting inner faces of both the supporting members 68 to locate the winding shaft 8 precisely at the winding position. When the fabric roll formed on the winding shaft 8 becomes a predetermined full size and it is required to be released from the bearing members 63, if the timings of the releasing of the two ends of the winding shaft 8 do not coincide with each other, or one end of the winding shaft 8 is not released from the bearing members 63, the fabric roll formed on the winding shaft 8 falls in an inclined condition. To prevent such trouble, each of the regulating members 69 restrains a supporting hook 70 in such a condition that the load for supporting the fabric roll is not imposed on chains 71*a*, 71*b*, each of which has a supporting hook 70** secured thereto.

In the above arrangement, when the cutting of the knitted fabric 6 is completed and the limit switch 48 (FIG. 7) is actuated, the rotation of the cutter 30 is stopped and, at the same time, the solenoids 61 and 67 are excited by the signal issued from the limit switch 48 to move the bearing members 57 and 63 to the shaft releasing directions (the direction reverse to the direction of the arrow in FIG. 13A and the direction reverse to the direction of the arrow in FIG. 13B, respectively) by way of the operation levers 60 and 66. Accordingly, the winding shaft 8 is released so that it is capable of rolling on the inclined guide face 68*a* of the supporting member 68.

As the bearing members 57 and 63 are moved in the shaft releasing directions, the limit switches 59 and 65 for confirmation of releasing of the winding shaft 8 are actuated by the inclined face 57*b* of the bearing member 57 and the engaging face 63*b* of the bearing member 63, respectively, to confirm releasing of the winding shaft 8.

After the above releasing operation, the winding shaft 8, whereon a full size fabric roll is formed, is rolled on the inclined guide face 68*a* and allowed to fall, when both the supporting hooks 70 separate from the winding shaft 8 by rotation of the chains 71*a* and 71*b*. This feature will be explained in detail hereinafter.

After the fully wound winding shaft 8 has been released and allowed to fall, a fresh winding shaft 8 is transferred to the winding position and, at this moment, the electromagnetic solenoids 61 and 67 are di-energized and the bearing members 57 and 63 which have been moved to the shaft releasing directions are shifted into the shaft supporting directions (the direction of the arrow in FIG. 13A and the direction of the arrow in FIG. 13B, respectively). Accordingly, the fresh winding shaft 8 which has been shifted to the winding position is supported at both ends by the bearing members 57 and 63, and the winding shaft 8 is set so that it can be rotated intermittently by the intermittent driving mechanism (not shown).

MECHANISM FOR SUPPLYING A FRESH WINDING SHAFT TO THE WINDING MECHANISM

The mechanism for supplying a fresh winding shaft 8 to the winding mechanism 7 of the circular knitting machine according to the present invention is hereinafter explained in detail with reference to FIGS. 3 and 15. This mechanism comprises a winding shaft feeding mechanism and a mechanism for automatically mounting a fresh winding shaft, received from the winding shaft feeding mechanism, on the winding mechanism. For the sake of a clearer understanding the invention, the winding shaft feeding mechanism is explained first. A pair of guide rails 76 inclined to the winding position of the winding mechanism 7 are disposed on the lower portion of a frame 75 secured to the lower portion of the supporting gear 2*b*, at positions corresponding to the positions of the shaft supporting frames 15*a* and 15*b*, in such a way that a plurality of fresh winding shafts 8 can be supported. Disc-like operation plates 78 are disposed at corresponding positions below guide rails 76 and each of the operation plates 78 is always turned and urged to the direction indicated by an arrow in FIGS. 3 and 15 by the pulling force of a spring 77. Electromagnetic solenoids 79 are disposed on the side portions of the operation plates 78, respectively, and the operation plates 78 are turned in the reverse direction (the direction reverse to the direction of the arrow in FIGS. 3 and 15) against the pulling forces of the springs 77 by the action of these electromagnetic solenoids 79, respectively.

The lower ends of engaging rods 79*a* and 79*b* are rotatably attached at suitable positions on both the left and right sides of each operation plate 78. With the reciprocative movement of the operation plate 78, the top ends of the engaging rods 79*a* and 79*b* can be alternately projected over the top faces of the guide rails 121 to feed fresh winding shafts 8 one by one to the mounting mechanism described below.

A sixth limit switch 80 is disposed at a position on the inside face of one of guide rails 76 on which a fresh winding shaft 8 stands by, and an operation member 80*a* of the limit switch 80 is downwardly projected to the lower part of a fresh winding shaft 8 to be fed next. Accordingly, even when a winding shaft 8 mounted on the winding mechanism becomes full, if no subsequent fresh winding shaft 8 stands by, since the operation member 80*a* has a tendency to turn upwardly by its own elasticity, the limit switch 80 does not issue any signal and the rotation of the motor 85 is prevented. Accordingly the automatic supply motion of the fresh winding shaft 8 does not take place.

The fresh winding shaft mounting mechanism will now be described with reference to FIGS. 3, 13 and 15. A rotary shaft 82 is rotatably supported between the above-mentioned frames 75 at a position above the winding shaft feeding mechanism. Driving sprocket wheels 83*a* (FIG. 3) and 83*b* (FIG. 15) are secured to both ends of the rotary shaft 82, respectively. A driven gear 84 is fixed at a position adjacent to one frame 75. A motor 85 is disposed at a position in close proximity to the driven gear 84 and a driving gear 86 is secured to the end of the driving shaft of the motor 85 in such a condition that the gear 86 is capable of engaging with the driven gear 84.

Brackets 87 are projected at positions of the supporting members 68 disposed on the lower ends of the shaft supporting frames 15*a* and 15*b*, respectively, and driven sprocket wheels 88*a* and 88*b* are rotatably supported on the brackets 87, respectively. A pair of endless chains 71*a*, and 71*b*, are mounted on the driven sprocket wheels 88*a* and 88*b* and the driving sprocket wheels 83*a* and 83*b*, respectively. Supporting hooks 70 of a crochet needle-like shape are attached at corresponding positions of the chains 71*a* and 71*b*, respectively, to transfer the fresh winding shaft 8 fed from the winding shaft feeding mechanism to the winding position of the winding mechansim. As shown in FIG. 15, a dog 90 is disposed at a position on the chain 71*b* to actuate a seventh limit switch 89 for energizing an electromagnetic solenoid 79 mounted near the driving sprocket wheel 83*b*. As shown in FIG. 3, another dog 92 is disposed at a position on the other chain 71*a* to actuate an eighth limit switch 91 for stopping the motor 85 mounted at a position in close proximity to the driving sprocket wheel 83*a*.

In the above described arrangement, when the limit switches 59 and 65 for confirmation of releasing of the winding shaft 8 are actuated by the movement of the bearing members 57 and 63 in the above-mentioned manner, i.e. the releasing of the fully wound winding shaft 8 from the bearing members 57 and 63 is confirmed, the motor 85 is started by actuation of the limit switches 59 and 65, and the chains 71*a* and 71*b* are rotated in a direction indicated by an arrow in FIG. 3 to move the supporting hook 70 which is located at the winding position. At this moment, as shown in FIGS. 3 and 13, the fully wound winding shaft 8, which has been held on the inclined guide face 68*a* of the supporting member 68, is released from this hold by the supporting hook 70, and turns on the inclined guide face 68*a* of the supporting member 68 and falls from the fall-out position at the top end of the inclined guide face 68*a*.

Figure 15:
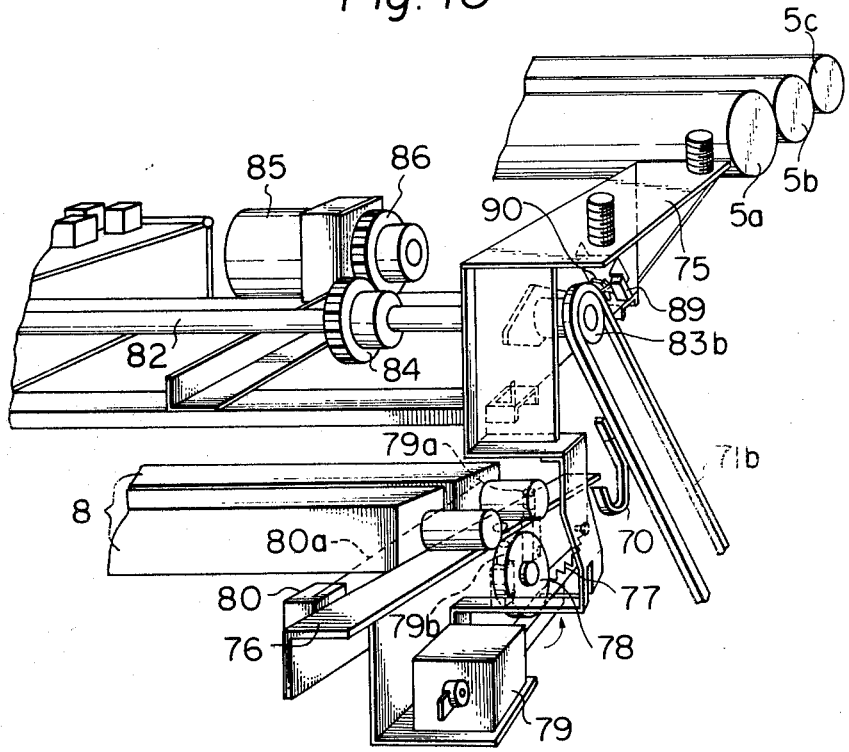
FIG. 15 is a perspective view of a mechanism for supplying a fresh winding shaft to the winding mechanism according to the present invention.

The supporting hook 70 is further moved in the direction of the arrow in FIG. 3 and arrives at a winding shaft receiving position indicated by a two-dot chain line in FIG. 3 and shown in FIG. 15. At this point, the limit switch 89 is actuated by the dog 90 to excite both electromagnetic solenoids 79, whereby the operation plates 78 are rotated in the direction reverse to the direction indicated by the arrow in FIGS. 3 and 15 and one engaging rod 79*a* kept in the projected state over the top face of the guide rail 76 is retracted, while the other engaging rod 79*b* kept in the retracted state is projected over the top face of the guide rail 76. Thus, the next winding shaft 8 is stopped at the proper position.

When the reverse winding shaft 8 at the stand-by position is released from the engagement with the engaging rod 79*a*, by retraction of the engaging rod 79*a* in the above-mentioned manner, the fresh winding shaft 8 is guided to the fall-out side on the guide rail 76 by the rolling of needle bearings 94*a* and 94*b* (see FIG. 19) and is allowed to fall on the supporting hooks 70 moved to the winding shaft receiving position. The fresh winding shaft 8 is then supported at both ends thereof by the supporting hooks 70. It should be noted that at the point when the switch 89 is actuated, if the full size fabric roll 8*a* which has fallen from the winding position is not shifted from the vicinity of the winding position by the transferring mechanism detailed hereinafter, the chains 71*a* and 71*b* are kept stopped until the roll 8*a* is shifted. In the normal operation, with rotation of the chains 71*a* and 71*b* the winding shaft 8 is shifted to the winding position by the supporting hooks 70 and both ends of the winding shaft 8 are placed on the inclined guide faces 68*a* of the supporting members 68. At this moment, the limit switch 91 is actuated by the dog 92 to stop the motor 81, whereby the movement of the supporting hooks 70 is stopped. By this actuation of the limit switch 91, the electromagnetic solenoids 61 and 67, for releasing the winding shaft 8, are de-energized and both the bearing members 57 and 63 are moved in the shaft supporting directions (the direction of the arrow in FIG. 13A and the direction of the arrow in FIG. 13B), whereby both ends of the winding shaft 8 are held so that are intermittently rotatable. After discharge of the full size fabric roll 8*a* outside the machine by the discharge mechanism has been confirmed, the knitting device 3 and the winding device 7 are started again to commence the knitting operation. The electromagnetic solenoids 61 and 67 may be set so that they are de-energized when the knitting device 3 and the winding device 7 are started again.

MECHANISM FOR TRANSFERRING DOFFED FABRIC ROLLS OUTSIDE THE KNITTING MACHINE

A preferred embodiment of the mechanism for transferring doffed fabric rolls outside the knitting is hereinafter explained in detail with reference to FIGS. 16, 17 and 18.

Figure 1:
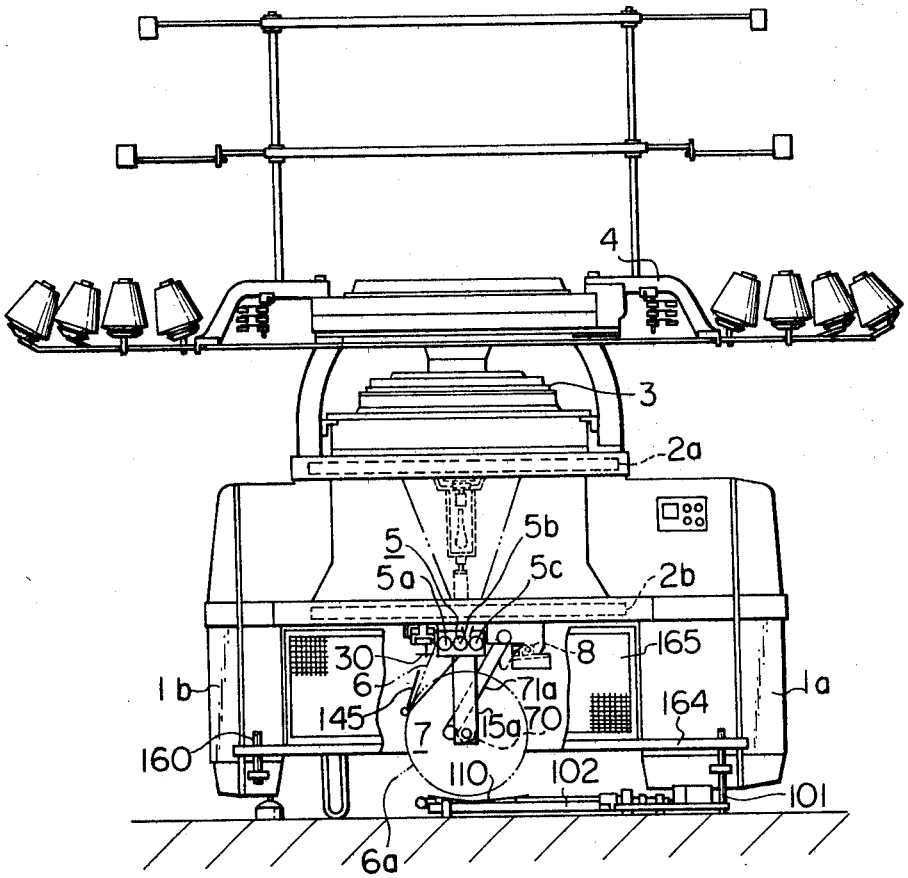
FIG. 1 is a schematic front view of a conventional circular knitting machine provided with an automatic apparatus for doffing fabric rolls therefrom according to the present invention.
Figure 2:
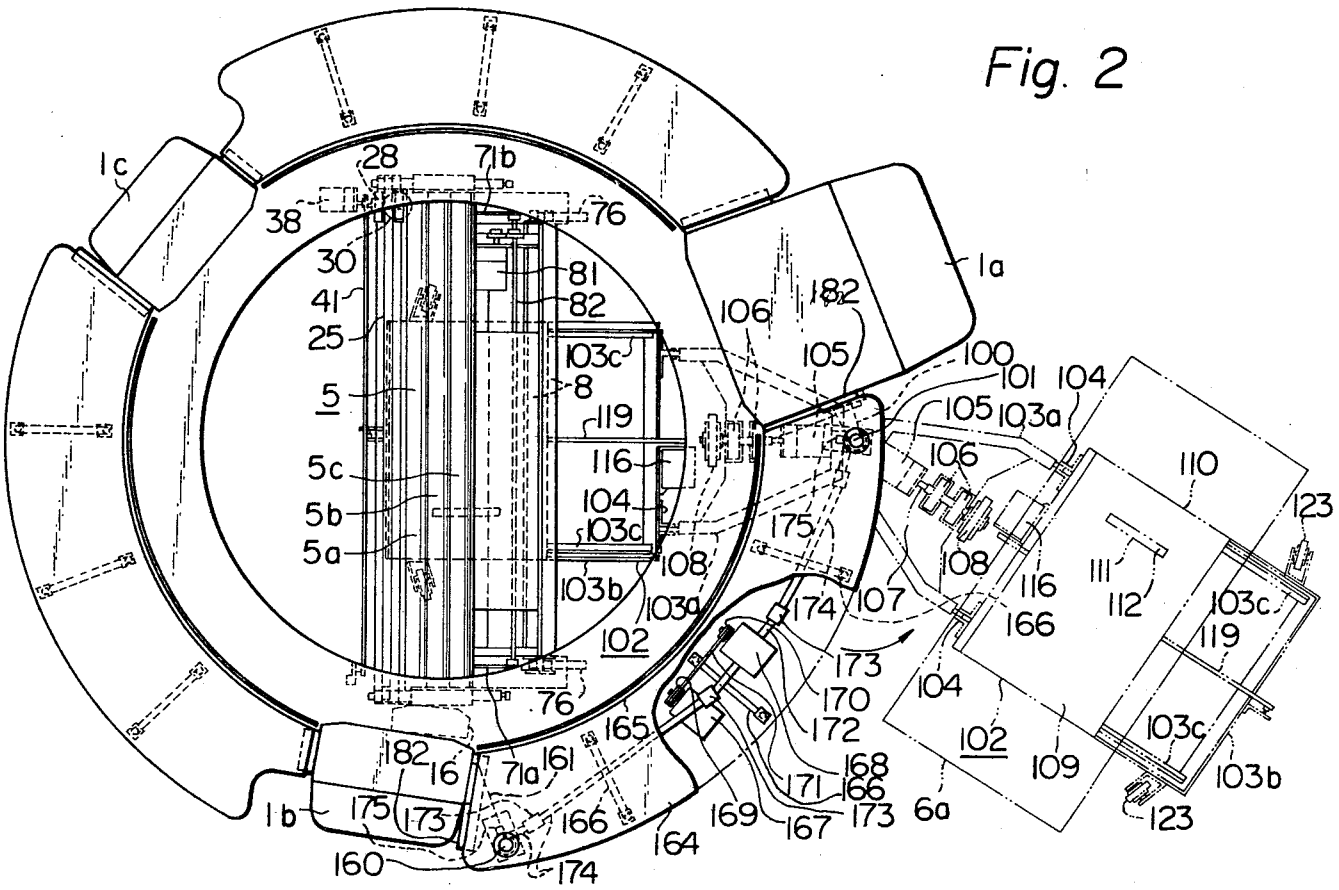
FIG. 2 is a schematic plan view of the circular knitting machine shown in FIG. 1.

A pillar 101 is vertically supported on one side face of one box frame 1*a* by upper and lower brackets 100. A truck 102 is attached to the lower end of the pillar 101, as shown in FIG. 2, so that the truck 102 can be rotated around the pillar 101. This truck 102 is divided into a driving stand 103*a* and a driven stand 103*b*, which are connected to each other through a connecting member 104, so that the truck 102 can be vertically bent at this connecting position.

A reversible motor 105 is disposed at a position on the top face of the driving stand 103*a* of the truck 102, and a driving wheel 108 for turning the entire body of the truck 102 is fixed to the end of a driving shaft 107 supported on a bearing 106 of the motor 105. A transportation stand 109 is mounted on the upper portion of the driven stand 103*b* of the truck 102 so that the transportation stand 109 can be reciprocated in the direction of the radius of a circle having its center at the axis of the pillar 101. A receiving plate 110, provided with a V-shaped face, is secured to the upper portion of the transportation stand 109 to prevent rolling of the full size fabric roll 8*a* received thereon. The transportion stand 109 is supported by wheels 110*a* in such a way that the transportation stand 109 is capable of moving on rails 103*c* laid on both the sides of the driven stand 103*b*.

Figure 16:
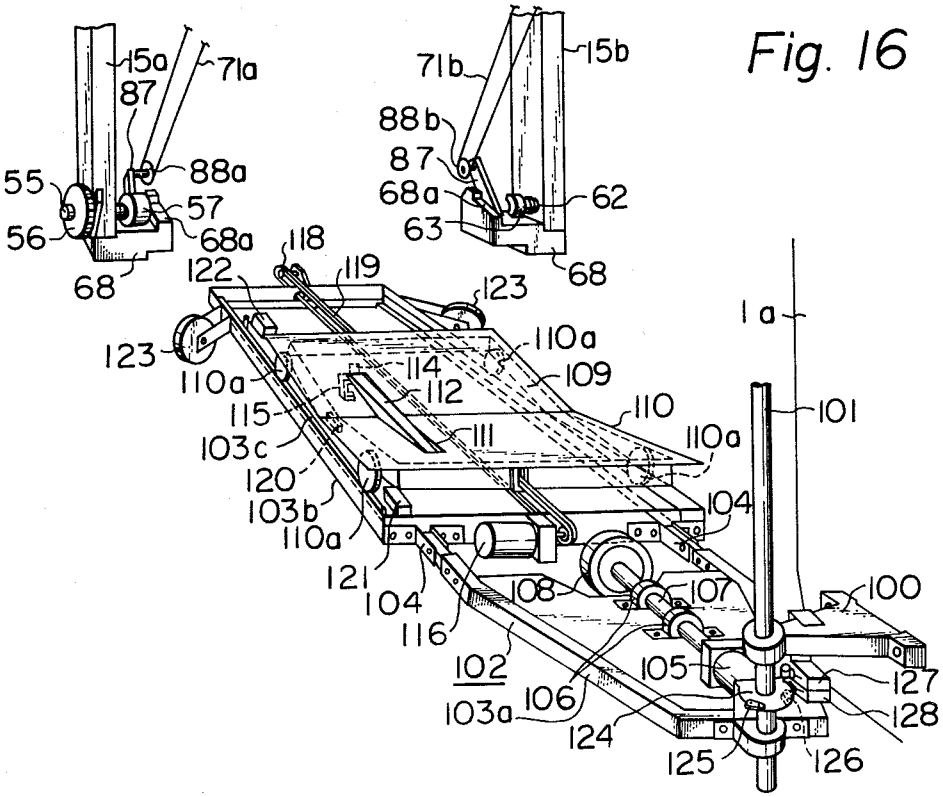
FIG. 16 is a perspective view of a mechanism for transferring doffed fabric roll outside the knitting machine according to the present invention.
Figure 17:
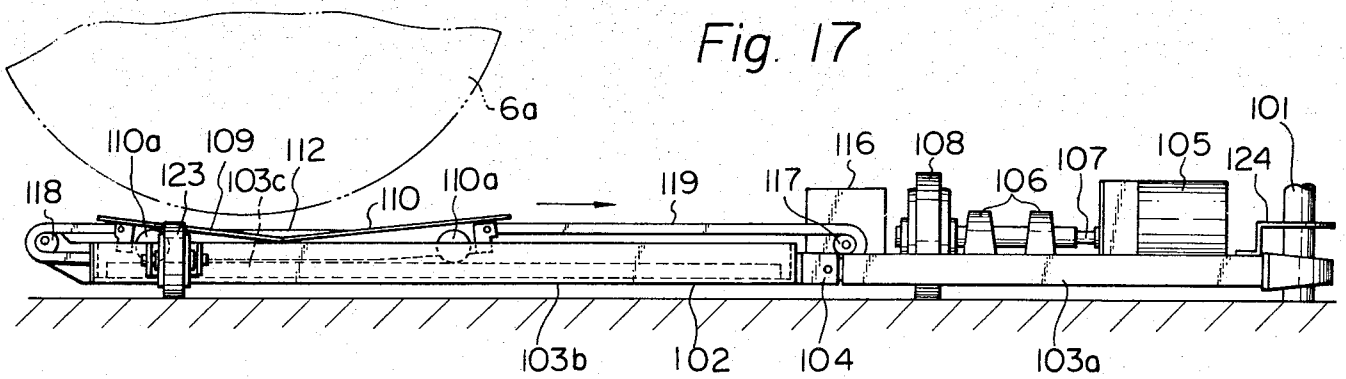
FIG. 17 is a front view of the transferring mechanism shown in FIG. 16.
Figure 18:
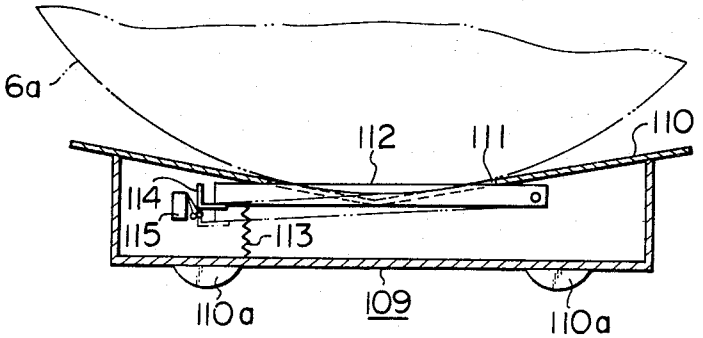
FIG. 18 is a schematic side view of a transportation truck utilized for the transferring mechanism shown in FIG. 16.

As shown in FIGS. 16 and 18, a rectangular window aperture 111 extended in the moving direction of the transportation stand 109 is formed at a position of the receiving plate 110. As shown in FIG. 18, an operation lever 112 is vertically rotatably pivoted on the lower portion of the receiving plate 110 at a position corresponding to that of the window aperture 111. The operation lever 112 is upwardly urged by a spring 113 so that the central portion of the operation lever 112 is projected beyond the top face of the receiving plate 110 through the window aperture 111. An engaging piece 114 having an L-shaped side face is disposed on the top end of the operation lever 112 to actuate a limit switch 115 for confirmation of the receiving of the fabric roll, which is disposed at a position corresponding to that of the top end of the operation lever 112.

A reversible motor 116 is disposed on the driven stand 103*b* on the side closer to the driving stand 103*a*. A driving sprocket wheel 117 is secured to the end of a driving shaft of the motor 116 and a driven sprocket wheel 118 is disposed on the driven stand 103*b* at a position opposite to a position where the driving sprocket wheel 117 is mounted. A chain 119 is mounted on the driving sprocket wheel 117 and the driven sprocket wheel 118, and the ends of the chain 119 are projected outside from the transportation stand 109, respectively.

Limit switches 121 and 122 which have actuating for levers (not shown) sensing and stopping the movement of the transportation stand 109 are mounted at the ends of the transportation stand 109 on the upper portion of the driven stand 103*b*. The switches 121 and 122 are actuated by a dog 120 disposed at the center of one side face of the transportation stand 109. Driven wheels 123 are disposed at both side-portions of the driven stand 103*b*, so that the wheels 123 can be rotated along an arc passage having a center which coincides with the axial center of the pillar 101.

As shown in FIG. 16, dogs 125 and 126 are disposed at positions on the upper and lower faces of a frame plate 124 mounted on the pillar 101 at the position where the truck 102 is disposed, to actuate limit switches 127 and 128 for stopping the truck 102 at a predetermined position. The limit switches 127 and 128 are disposed below the bracket 99.

In the above described arrangement, when both ends of the winding shaft 8 on the inclined guide face 68*a* of the supporting member 68 are released, and the winding shaft 8 rolls on the inclined guide face 68*a* of the supporting member 68 and is allowed to fall onto the receiving plate 110 of the transportation stand 109, since the receiving plate 110 is formed so as to have a V-shaped side face, the full size fabric roll 8*a* formed on the winding shaft 8 is stably supported at the central position. When the fabric roll 8*a* is supported by the receiving plate 110, the operation lever 112 is pushed down by the peripheral face of the fabric roll 8*a*, and the limit switch 115, for confirmation of the receiving of the fabric roll 8*a*, is actuated by the engaging piece 114 disposed at the top end of the operation lever 112. As a result of this, the motor 116 is rotated in the normal direction and the transportation stand 109 at the doffing position is moved toward the pillar 101 (in a direction indicated by an arrow in FIG. 17). When the limit switch 121 is actuated by the dog 120 of the transportation stand 109, the motor 116 is stopped to stop the transportation stand 109 at the fabric roll discharge position.

When the switch 121 is actuated, the motor 105 is rotated in the normal direction and the truck 102 is rotated with the pillar 101 as the center, in the direction of the arrow in FIG. 2 by the driving wheel 108 disposed on the end of the driving shaft 107 of the motor 105. As a result, the fabric roll 8*a* placed on the receiving plate 110 of the stand 109 is discharged outside the machine. When the limit switch 127 is actuated by the dog 125, the motor 105 is stopped and the truck 102 is stopped at a fixed position outside the machine (the position indicated by a two-dot line in FIG. 2). Discharge of the fabric roll 8*a* outside the machine is thus confirmed by the limit switch 127, and the knitting device 3 and the winding device 7 are started again. Then, the discharged fabric roll 8*a* is removed from the receiving plate 110 of the transportation stand 109 by an operator. Even after the knitting device 3 and the winding device 7 have been started again, if the removal of the fabric roll 8*a* by the operator is not performed, the truck 102 is kept in the fabric roll discharge position.

The truck 102 positioned outside the machine is turned in the direction reverse to the direction of the arrow of FIG. 2 with the pillar 101 as the center, when the motor 105 is rotated in the reverse direction by the control panel operation by the operator. When the limit switch 128 is actuated by the dog 126, the motor 105 is stopped at a predetermined position in the machine indicated by a solid line in FIG. 2. Simultaneously, the motor 116 is rotated in the reverse direction and the transportation stand 109 is moved in the direction which is opposite to the direction toward the pillar 101 (the direction which is opposite to the direction of the arrow in FIG. 17), whereby the limit switch 122 is actuated by the dog 120 to stop the transportation stand 109 at the doffing position shown in FIG. 17.

MECHANISM FOR FIXING A CUT END PORTION OF THE KNITTED FABRIC ON A FRESH WINDING SHAFT MOUNTED ON THE WINDING MECHANISM

The mechanism for automatically fixing a cut-end portion of the knitted fabric on a fresh winding shaft mounted on the winding mechanism, which is one of the auxiliary mechanisms according to the present invention is hereinafter explained in detail.

Figures 19, 20, 21, 22, 23A, 23B, 23C:
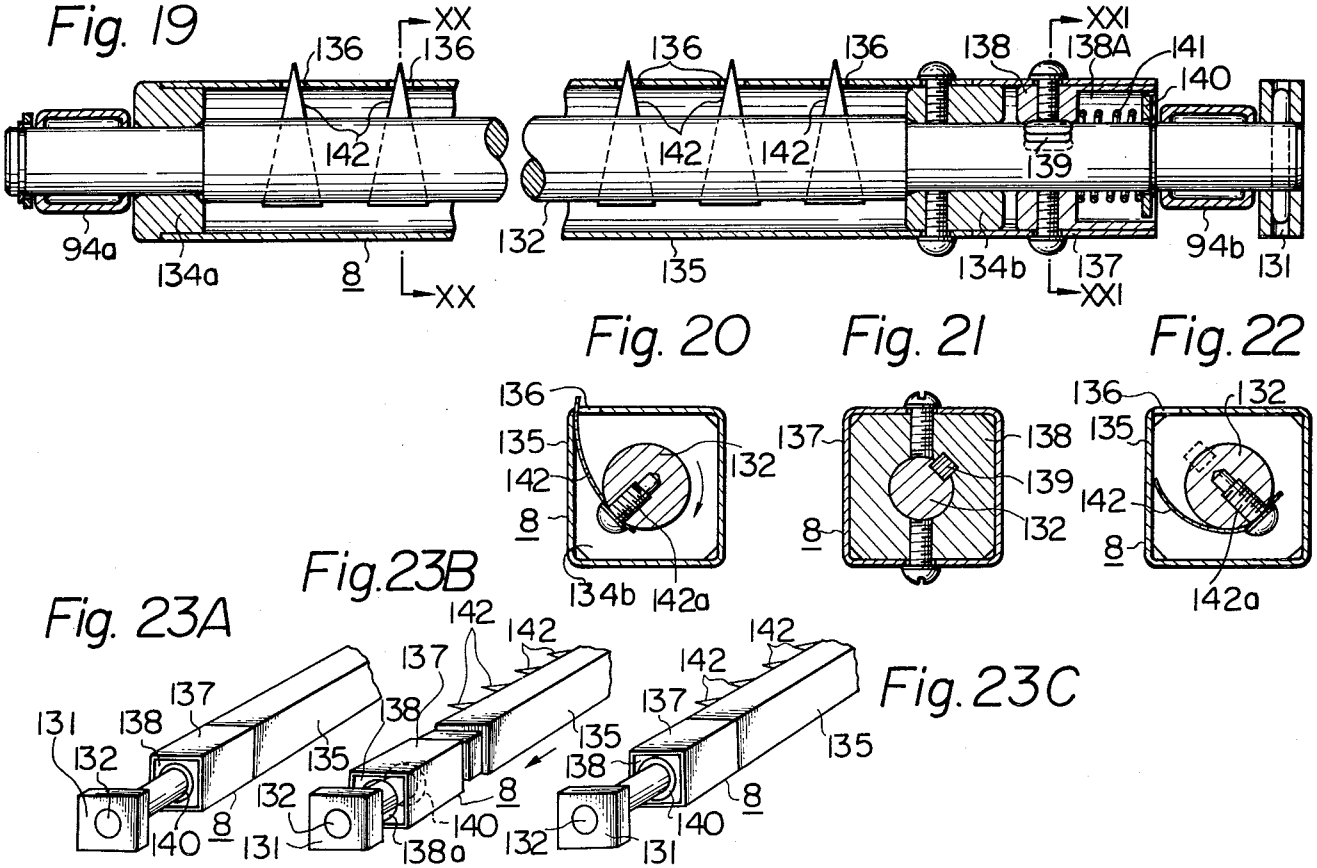
FIG. 19 is a front view of the winding shaft utilizing for the doffing apparatus, partly in cross-section, according to the present invention.
FIGS. 20 and 21 are cross-sectional views of the winding shaft, taken along a line XX—XX, and a line XXI—XXI, in FIG. 19, respectively.
FIG. 22 is a cross-sectional view of the winding shaft taken along a line XX—XX, in a condition that the engaging click is retracted into the square shell thereof, in FIG. 19, FIGS. 23A, 23B and 23C are perspective views of the winding shaft shown in FIG. 19, indicating the operative steps thereof.

An embodiment of a winding shaft 8 utilized for the automatic doffing apparatus according to the present invention is firstly explained in detail, with reference to FIGS. 19 through 23. The winding shaft 8 of this embodiment shown in FIGS. 19 through 23 comprises a body shaft 132 provided with a pair of needle bearings 94*a* and 94*b* mounted on the two end portions thereof and an engaging member 131 rigidly mounted on one of the free end portions thereof, for example a free end outside the needle bearing 94*b*. The engaging member 131 is provided with a square cross-section. The needle bearings 94*a* and 84*b* mounted on the body shaft 132 are capable of rolling on the inclined guide faces 68*a* of the supporting member 68 shown in FIGS. 13A and 13B and on the guide rail 76 shown in FIG. 15. A square shell 135 is mounted on the body shaft 132 at a position between the needle bearings 94*a* and 94*b* in such a way that a pair of holding members 134*a* and 134*b*, which are turnably mounted on the body shaft 132, firmly support the two ends of the square shell 135 as shown in FIG. 19. A plurality of openings 136 are formed on one corner portion of the square shell 135 equidistantly along the lengthwise direction of the body shaft 132. A moving member 138 is slidably mounted on the body shaft 132 by way of a key 139 at a position between the holding member 134*b* and the needle bearing 94*b*. And an auxiliary square shell 137, having a section of the same shape as the sectional shape of the square shell 135, is rigidly mounted on the moving member 138 in such a way that an inside end portion of the auxiliary square shell 137 is slidably positioned on the holding member 134*b* so that this inside end portion of the auxiliary square shell 137 is capable of urging the outside end of the square shell 135 when the auxiliary square shell 137 is positioned at its most inside position with respect to the body shaft 132. The key 139 is fixed to the body shaft 132 and a key groove is formed on the side of the moving member 138.

On the side face of the moving member 138 facing the needle bearing 94*b*, a spring-containing, U-shaped member 138*a* is formed, and a spring 141 is disposed between the bottom face of the member 138*a* and a stop plate 140 fixed just near the needle bearing 94*b*. A plurality of engaging clicks 142 having a sharp toe end are fixed to the body shaft 132 at positions corresponding to the positions of the projection openings 136 by means of a bolt 142*a*, respectively. As shown in FIG. 20, when the body shaft 132 is rotated in a direction indicated by an arrow, the top end of the click 142 is projected from the projection opening as shown in FIGS. 20, 23B and 23C. In this winding shaft 8, in order to project the engaging click 142, which is kept in the retracted condition into the square shell 135 as shown in FIGS. 22, 23A, the moving member 138 is moved together with the square auxiliary shell 137 against the force of the spring 141 in a direction indicated by an arrow in FIG. 23B and, in this condition, the moving member 138 is turned 90° in the counterclockwise direction. If the engaging click 142 is projected in the above-mentioned manner, the moving member 138 is returned to the original position by the force of the spring 141 while keeping the moving member 138 in the above-mentioned turned condition, as shown in FIG. 23C. According to the above-mentioned operation, the engaging clicks 142 are stably projected outside from the respective openings 136 of the square shell 135 of the winding shaft 8 as shown in FIG. 23C.

Figure 24:
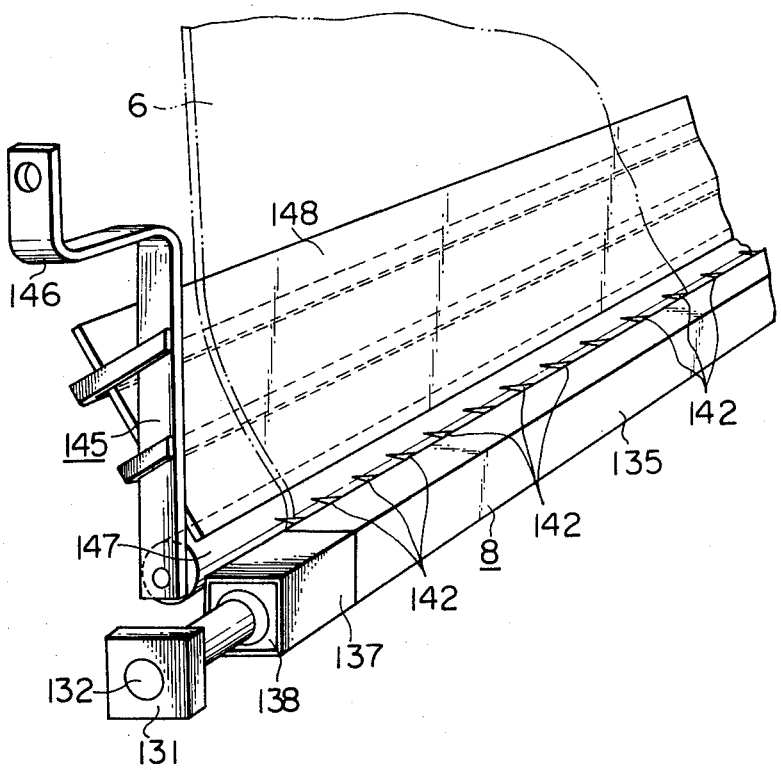
FIG. 24 is a schematic perspective view of the mechanism for fixing a cut-end portion of the knitted fabric onto a fresh winding shaft mounted on the winding mechanism according to the present invention.

An embodiment of a guide frame 145 for guiding the cut end of the knitted fabric 6 to the winding shaft 8 at the winding position will now be described by reference to FIGS. 3, 4 and 24. A pair of holding frames 146 are rotatably attached at the centers of the confronting inner faces of the shaft supporting frames 15*a* and 15*b*.

A press roller 147 is rotatably supported between the lower ends of the holding frames 146, so that the press roller 147 falls in sliding contact with the peripheral face of the fabric roll 6a formed on the winding shaft 8. Consequently the press roller 147 ensures precise winding of the knitted fabric 6 on the winding shaft 8. A guide plate 148 is attached to the holding frame 146 at a position above the press roller 147 in such a way that it downwardly inclines to the knitted fabric winding position.

In the above arrangement, the cut end of the knitted fabric 6 drapes down from the takeup device 5 and this fabric 6 is introduced to the winding position by the guide plate 148 of the guide frame 145 and caught by the engaging click 142 of the winding shaft 8 which is rotating, whereby the cut end of the knitted fabric 6 is wound on the winding shaft 8.

Another embodiment of the mechanism for fixing the cut end of the knitted fabric 6 on the winding shaft 8 will now be described with reference to FIGS. 25A, 25B and 25C. In the embodiment, the cut end of the knitted fabric 6 is positively wound in the winding shaft 8. The holding frames 146 are arranged in upright condition and a shaft 149 is rotatably mounted between the lower ends of the holding frames 146. A press roller 147 is freely mounted on the shaft 149 and a driven gear 150 is secured to one end side of the shaft 149. Curved rotary frames 151 are rigidly mounted on both ends of the shaft 149 and jump-up plates 152, having an L-shaped bent form, are attached to the top ends of the rotary frames 151. A rotary member 153, having on a part of its peripheral edge a toothed portion 153a to be engaged with the driven gear 150, is disposed at a position corresponding to the position of the driven gear 150 on the central shaft 132 of the winding shaft 8.

Figure 25A:
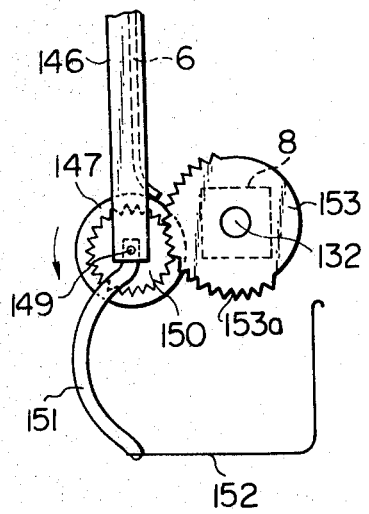
FIGS. 25A, 25B and 25C are schematic side views of modified embodiment of the mechanism for fising a cut-end portion of the knitted fabric onto a fresh winding shaft mounted on the winding mechanism, in three successive steps of the operation, according to the present invention.
Figure 25B:
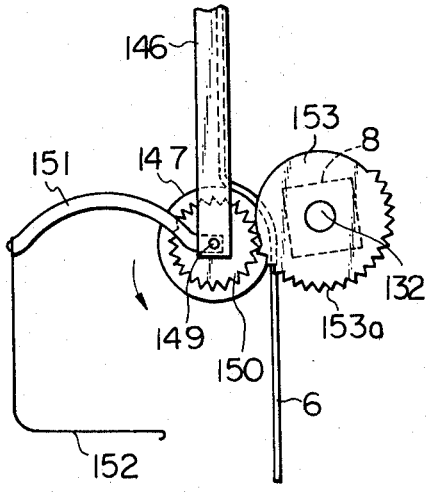

In the condition where the driven gear 150 is engaged with the toothed portion 153a of the rotary member 153 as shown in FIG. 25A, when the rotary member 153 is rotated by rotation of the winding shaft 8, the rotary frame 151 is turned in a direction reverse to the direction indicated by an arrow. When the engagement between the driven gear 150 and the toothed portion 153a of the rotary member 153 is released as shown in FIG. 25B, the driven gear 150 is set free and the rotary frame 151 is turned in the direction of the arrow in FIG. 25B by its own weight and the weight of the jump-up plate 152. At this moment, the cut end of the draped-down knitted fabric 6 is jumped up above the winding shaft 8 by the top end of the jump-up plate 152 and wound on the winding shaft 8 as shown in FIG. 25C.

Figure 25C:
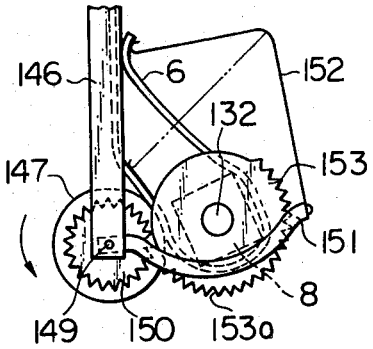

If the jump-up plate 152 is so arranged that when the jump-up plate 152 is rotated in the direction of the arrow, the top end thereof is positioned as indicated by a broken line in FIG. 25C and the knitted fabric is fixed to the winding shaft 8.

AN AUXILIARY MECHANISM FOR FACILITATING THE DISPLACEMENT OF THE TRANSPORTATION TRUCK OUTSIDE THE KNITTING MACHINE

Figure 26:
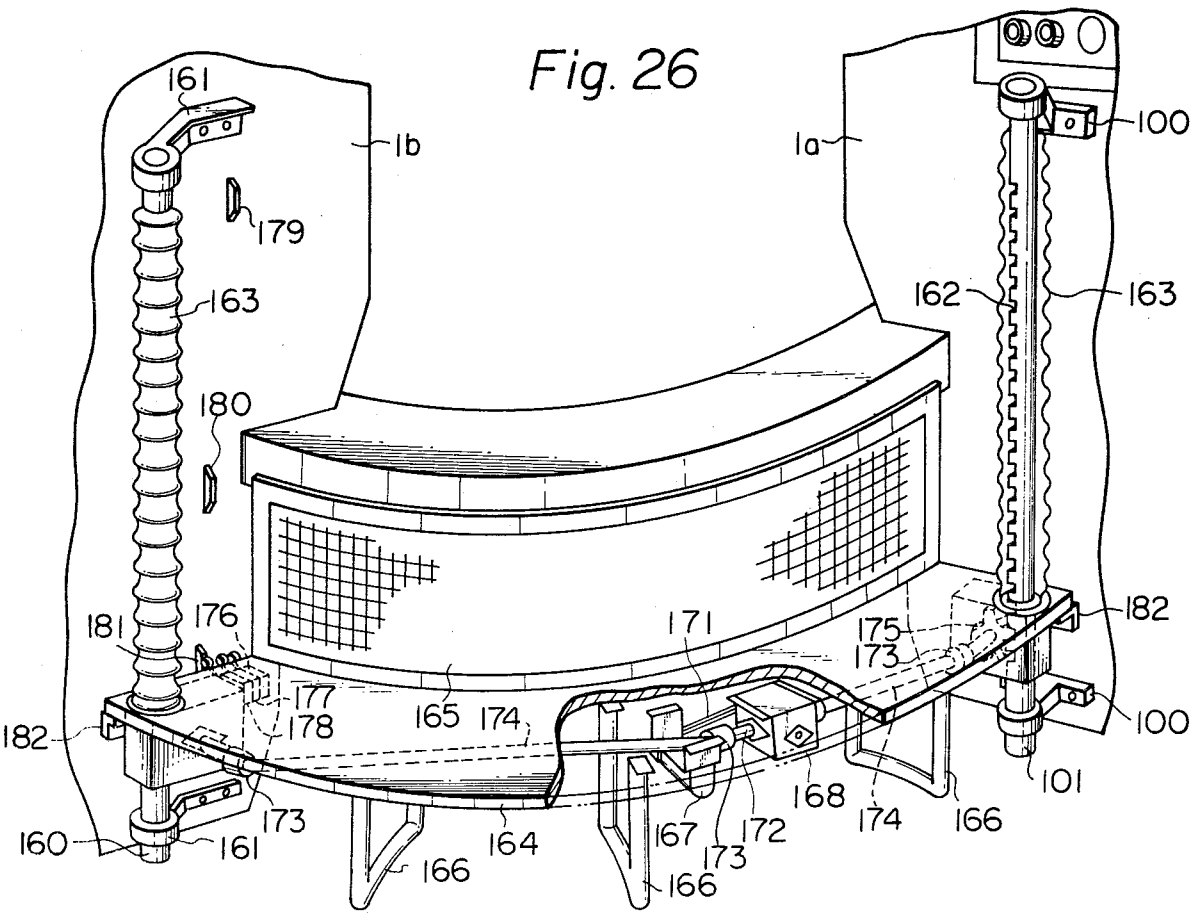
FIG. 26 is a perspective view of an auxiliary mechanism for displacing a transportation truck from the inside of the knitting machine toward a position outside the machine and vice versa.

An auxiliary mechanism for automatically moving the step 164 and safety cover 165 to facilitate the displacement of the transportation truck outside the knitting machine according to the present invention is hereinafter explained in detail with reference to FIGS. 2 and 26. This mechanism is utilized for displacing the truck 102 from the receiving position of a full size fabric roll 6a inside the knitting machine to the outside of the knitting machine.

A pillar 160 is supported by a bracket 161 parallel to the pillar 101 on the side of the box frame 1b at a position corresponding to that of the pillar 101 of the box frame 1b. Rack 162 is mounted on the pillars 101 and 160 to extend in the longitudinal directions of the pillars 101 and 160, and the major portions of the hooks 162 are covered by a cover 163.

A step 164 is disposed in such a way that it can be moved vertically along the pillars 101 and 160. A safety cover 165 composed of a metal net, is fixed to the upper inside portion of the step 164, and a plurality of supporting legs 166 are mounted on the lower face of the step 164 to support the step 164. On the lower face of the step 164, there are disposed a motor 167, and a reduction gear 168. A chain 171 is mounted on a driving sprocket wheel 169, secured to the end of a driving shaft of the motor 167, and a driven sprocket wheel 170 fixed to the end of an input shaft of the reduction gear 168 as shown in FIG. 2.

Both ends of an output shaft 172 projected from both sides of the reduction gear 168 are elongated toward the pillars 101 and 160 by a plurality of universal joints 173 and a plurality of connecting shafts 174. Pinions 175 to be engaged with racks of the pillars 101 and 160 are fixed to both ends of the output shaft 172 of the reduction gear 168.

Limit switches 176 and 177, for stopping the rising movement of the step 164 and a limit switch 178, for stopping the descending movement of the step 164, are disposed on the lower face of the step 164 on the side of the box frame 1b. These three limit switches are actuated according to the vertical movement of the step 164 by dogs 179 to 181 disposed on the box frame 1b in such a way that these limit switches are spaced from one another in the vertical direction. Angular supporting members 182 are disposed on the confronting side faces of the box frames 1a and 1b at the same height as that of the supporting legs 166 to support both ends of the step 164 when it descends.

In the above arrangement, when the full size fabric roll 6a is allowed to fall on the receiving plate 110 of the transportation stand 109 of the transferring mechanism and the switch 115 is actuated by the engaging piece 114 formed on the top end of the operation lever 112, the motor 167 is rotated in the normal direction and the pinions 175 are rotated by way of the driving sprocket wheel 169, chain 171, driven sprocket wheel 180, reduction gear 168, output shaft 182, universal joints 183 and connecting shafts 184, whereby the step 164 and safety cover 165 are lifted up along the pillars 101 and 160, and; when the switch 176 is actuated by the dog 179, the motor 167 is stopped and the step 164 and safety cover 165 are stopped at the raised positions.

When the full size fabric roll 6a is discharged outside the machine by the truck 102 of the transferring mechanism and the switch 127 is actuated by the dog 125, the motor 167 is rotated in the reverse direction and the pinions 175 are turned in the direction opposite to the direction in the above case. Accordingly, the step 164 and safety cover 165 kept at the raised positions are lowered along the pillars 101 and 160, and when the switch 178 is actuated by the dog 181, the motor 167 is stopped and the step 164 and safety cover 165 are stopped at the lowered positions.

When the full size fabric roll 6a is discharged outside the machine, the discharged fabric roll is manually removed from the transportation stand 109 by an operator and an operation control panel (not shown) is operated by the operator so that the motor 167 is rotated in the normal direction and the pinions 175 are rotated, whereby the step 164 and safety cover 165 are lifted up. In this case, however, when the switch 177 is actuated by the dog 180, the motor 167 is stopped and the step 164 and safety cover 165 are stopped at such positions as will allow only passage of the transferring mechanism.

Then, the transferring mechanism is returned to the standby position inside the circular knitting machine, and when the switch 122 is actuated by the dog 120 mounted on the transportation stand 109, the step 164 and safety cover 165 are lowered in the same manner as described above.

CONTROL CIRCUIT UTILIZED FOR THE MECHANISM FOR STOPPING THE WINDING SHAFT TOGETHER WITH THE KNITTING DEVICE AND TAKEUP AND WINDING MECHANISMS

Figure 27:
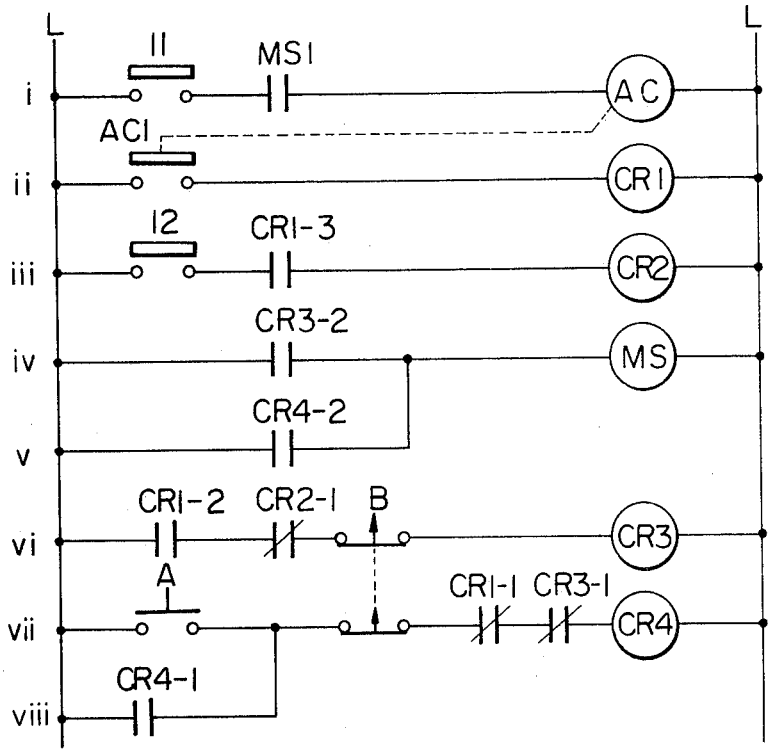
FIG. 27 is a diagram of a control circuit for controlling the stop motion of the entire knitting machine, according to the present invention.

A preferable embodiment of the control circuit utilized for the mechanism for stopping the winding shaft together with the knitting device and the takeup and winding mechanisms according to the present invention is hereinafter explained in detail with reference to FIG. 27. In FIG. 27, the first to eighth parallel circuits are connected between power source terminals L and L. In the first circuit *i*, there are connected in series the first proximity switch 11 for sensing the condition that the size of the fabric roll 6*a* has become a predetermined full size, a normally closed contact MS1 to be closed or opened by a contactor MS of a main motor for driving the circular knitting machine and an automatic counter AC for counting the frequency of closing actuation of the first proximity switch 11. In the second circuit *ii*, there are connected in series a counter switch AC1 which is closed when a prescribed value is attained in the automatic counter AC of the first circuit *i* (when the winding shaft becomes full) and the first relay CR1.

The automatic counter AC counts the number of rotations of the machine, and it can optionally be set so that when the counted number reaches a value corresponding to a desired size of the fabric roll 6*a* formed on the winding shaft 8, the counter switch AC1 is closed.

In the third circuit *iii*, there are connected in series a second limit switch 12 for stopping the machine at a fixed position, a normally open contact CR1-3 of the first relay CR1 and a second relay CR2. In the fourth circuit *iv*, there are connected in series a normally open contact CR3-2 of a third relay CR3 and the contactor MS of the main motor. In the fifth circuit *v*, a normally open contact CR4-2 of a fourth relay CR4 is connected in parallel to the normally open contact CR3-2 of the fourth circuit *iv*.

In the sixth circuit *vi*, there are connected in series a normally open contact CR1-2 of the first relay CR1, a normally closed contact CR2-1 of the second relay CR2, a stop switch B and the third relay CR3 for reducing the rotation speed of the main motor. In the seventh circuit *vii*, there are connected in series a starting switch A, the stop switch B, a normally closed contact CR1-1 of the first relay CR-1, a normally closed contact CR3-1 of the third relay CR3 and the fourth relay CR4 for changing the speed of the main motor to a high speed. In the eighth circuit *viii*, a self-retention contact CR4-1 of the fourth relay CR4 is connected in parallel to the starting switch A.

The functions of the above mentioned control circuit for the mechanism for stopping the machine at a predetermined angular position, will now be described.

When the starting switch A is closed, the seventh circuit *vii* is closed to energize the fourth relay CR4, whereby the self-retention contact CR4-1 of the eighth circuit *viii* is closed and the fourth relay CR4 is self-retained regardless of opening of the starting switch 4. When the fourth relay CR4 is thus energized, the main motor is set so that a high speed rotation is possible and, simultaneously, the normally open contact CR4-2 of the fifth circuit *v* is closed to close the contactor MS of the main motor and start the main motor. Accordingly, the machine is rotated at the prescribed high speed and the knitting operation is initiated.

When the contactor MS of the main motor is closed, the normally open contact MS1 of the first circuit *i* is closed and there is attained a state where the automatic counter AC can count the number of rotations of the machine based on the frequency of the closing actuation of the first limit switch 11. Accordingly, as shown in FIG. 5, as the rotation number of the machine increases, the dog 13 approaches the first and second limit switches 11 and 12, and both limit switches 11 and 12 are closed. Since the normally open contact of the contactor MS of the main motor has already been closed, the first circuit *i* is closed every time the first limit switch 11 is closed, and the number of rotations of the machine is counted by the automatic counter AC. In contrast, since the normally open contact CR1-3 of the first relay CR1 is kept open, the third circuit *iii* is not closed even if the second limit switch 12 is closed.

A knitted fabric 6 is formed by rotating the circular knitting machine and the knitted fabric 6 is wound on a winding shaft 8 by the winding device 7 (FIG. 2). When the number counted by the automatic counter AC reaches a prescribed value (when the fabric roll formed on the winding shaft 8 becomes a predetermined full size), the counter switch AC1 of the second circuit *ii* is closed to close the second circuit *ii* and energize the first relay CR1. When the first relay CR1 is thus energized, the normally closed contact CR1-1 of the seventh circuit *vii* is opened to de-energize the fourth relay CR4 and close the normally open contact CR1-2 of the sixth circuit *vi*, whereby the sixth circuit is closed and the third relay CR3 for reducing the rotation speed of the main motor is energized. Accordingly, the speed of the main motor is changed from a predetermined high speed to a predetermined low speed. At this time, by de-energizing the fourth relay CR4, the self-retention contact CR4-1 of the eighth circuit *viii* is opened and the self-retention of the fourth relay CR4 is released. Simultaneously, by energizing the third relay CR3, the normally closed contact CR3-1 of the seventh circuit *vii* is opened. Accordingly, simultaneously with closing of the sixth circuit *vi*, the seventh circuit *vii* is opened and the above-mentioned change-over of the speed of the main motor can be performed very precisely.

When the fourth relay CR4 is de-energized, the normally open contact CR4-2 of the fifth circuit *v* is opened, but since the normally open contact CR3-2 is closed by energizing of the third relay CR3, the contactor MS of the main motor of the fourth circuit *iv* is still kept in the energized state. Accordingly, the high speed rotation of the main motor is changed to the low speed rotation, whereby the rotation speed of the machine is reduced.

When the first relay CR1 is energized, the normally open contact CR1-3 of the third circuit *iii* is closed, and the second relay CR2 is kept in such a condition that when the second limit switch is closed and the third circuit *iii* is closed, the second relay CR2 is energized. Accordingly, when the rotation speed of the machine is sufficiently reduced and the dog 13 approaches the second limit switch 12 and closes it, the third circuit *iii* is closed and the second relay CR2 is energized. By energizing of the second relay CR2, the normally closed contact CR2-1 of the sixth circuit *vi* is opened to open the sixth circuit *vi* and de-energize the third relay CR3.

By de-energizing of the third relay CR3, the normally closed contact CR3-1 of the seventh circuit *vii* is closed and the normally open contact CR3-2 of the fourth circuit *iv* is opened, whereby the contactor MS of the main motor is opened and the motor is stopped. Accordingly, the machine which has been rotated at the predetermined low speed is stopped precisely at a predetermined angular position where the second proximity switch 21 confronts the dog 13 and the fabric roll 6*a* formed on the winding shaft 8 supported by the winding mechanism 7 is stopped at the above-mentioned predetermined angular position confronting the transferring mechanism shown in FIG. 16. At this moment the current collector 14 confronts the electricity feeding device 16, and electricity is applied to the respective mechanisms to be rotated with the machine, such as the automatic cutting mechanism, etc.

After the series of the foregoing operations have been conducted, the automatic counter AC is connected to a separate resetting circuit (not shown) to clear the recorded number and return the counter to zero, and the counter then stands by for the next operation of the machine.

When it is desired to stop the machine during the normal operation, the stop switch B of either the sixth circuit *vi* or the seventh circuit *vii* is operated to open it. Thus, the contactor MS of the main motor of the fourth circuit *iv* is opened and the main motor is stopped, whereby the rotation of the machine is stopped.

As is apparent from the foregoing illustration, in the above embodiment, the apparatus is so constructed that the rotation speed of the machine is sufficiently reduced during the period between the time the dog 13 approaches the first limit switch 11, to change the speed of the machine from the high speed to the low speed, and the time the dog 13 approaches the second limit switch 12. If the speed of the machine is not sufficiently reduced to a desired level during the above-mentioned period, it is possible to modify the present invention in the following manner.

Figure 28:
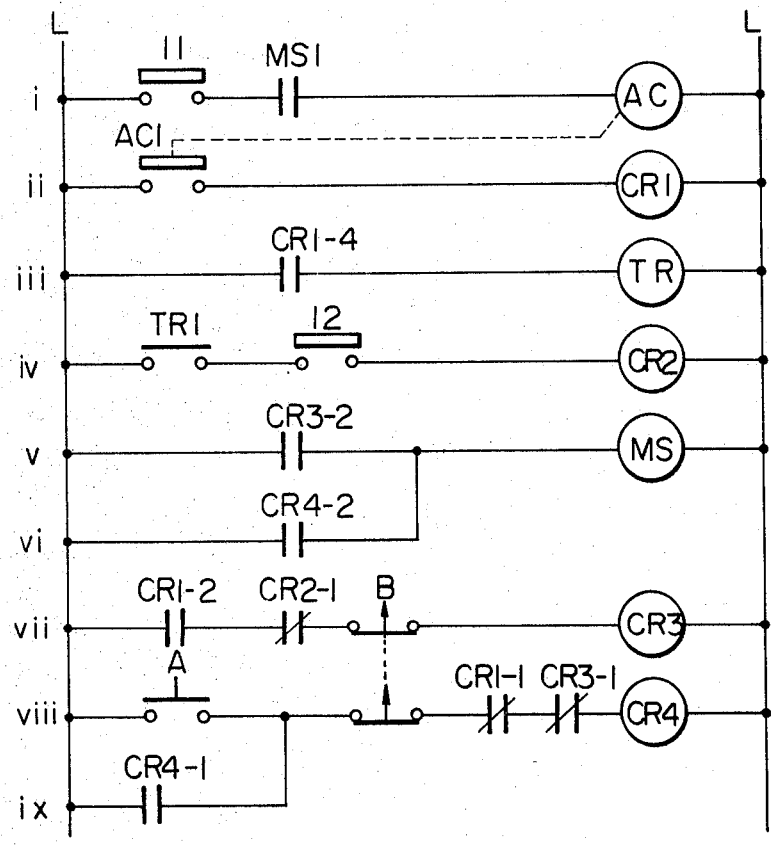
FIG. 28 is a diagram of an alternate control circuit which is a modification of the control circuit shown in FIG. 27.

This embodiment will now be described by reference to the control circuit diagram of FIG. 28, mainly with regard to differences from the foregoing embodiment.

In a circuit *iii*, a normally open contact CR1-4 of the first relay CR1 and a timer TR for setting a time required for reducing the rotation speed of the machine to a sufficiently low level are connected in series, and; in a circuit *iv* there are connected in series a timer switch TR1 of the timer TR, the second limit switch 12 for stopping the machine at a predetermined angular position and the second relay CR2. These two circuits are formed instead of the third circuit *iii* in the first embodiment shown in FIG. 27.

In the above arrangement, when the counted number of the automatic counter AC of the first circuit *i* reaches a prescribed value and the counter switch AC1 is closed to close the second circuit *ii* and energize the first relay CR1, the normally open contact CR1-4 of the circuit 3*a* is closed to close the circuit *iv* and the timer TR is set. When the time set by the timer has passed, the timer switch TR1 is closed and the second relay CR2 is kept in such a condition that it is energized when the second limit switch 12 is closed and the circuit 3*b* is closed.

Accordingly, when the dog 13 approaches the second limit switch 12 to close the second limit switch 12, the circuit *iv* is closed to energize the second relay CR2, whereby the machine is stopped at the predetermined angular position in the same manner as in the first embodiment shown in FIG. 27.

SUCCESSIVE STEPS OF THE AUTOMATIC DOFFING OPERATION OF THE FABRIC ROLLS ACCORDING TO THE PRESENT INVENTION

The successive steps of doffing fabric rolls from the winding mechanism of the circular knitting machine according to the present invention are hereinafter explained collectively.

When a knitted fabric 6 produced by the knitting mechanism 3 is wound on the winding shaft 8, and when the fabric roll 6*a* formed on the winding shaft 8 becomes a predetermined full size, the knitting device 3 and the winding device 7 are stopped at a predetermined common angular position by the stopping mechanism shown in FIG. 5. At the same time as the above-mentioned stop motion, electricity is applied by the current collector 14 connected to the electricity feeder as shown in FIGS. 5 and 6 and, then, the knitted fabric 6 is cut between the takeup mechanism 5 and the fabric roll 6*a* formed on the winding shaft 8 by the cutting mechanism shown in FIG. 7. At this time, the winding shaft 8 mounted on the winding mechanism 7 is released from the winding mechanism in such a way that both ends of the winding shaft 8 are simultaneously released from the bearing members 63 of the winding mechanism 7. Consequently, needle bearings 94*a*, 94*b* (FIG. 19) of the winding shaft 8 roll on the inclined guide face 68*a* of the supporting member 68, as shown in FIG. 13, and the full size fabric roll 6*a* is allowed to fall together with the winding shaft 8 onto the truck 102 of the transferring mechanism shown in FIG. 16 and discharged outside the knitting machine.

When the full size fabric roll 6*a* is allowed to fall on the truck 102 of the transferring mechanism, a fresh winding shaft 8 is fed from the automatic device for supplying a fresh winding shaft and, then, is mounted on the winding mechanism 7 by way of the automatic mechanism for mounting the fresh shaft on the winding mechanism 7 as shown in FIGS. 3 and 15. The free cut end portion of the knitted fabric 6, draped from the takeup device 5, is automatically wound on the above-mentioned fresh winding shaft 8 mounted on the winding mechanism by means of the fixing mechanism shown in FIG. 24. At the same time as the above-mentioned winding motion of the free cut end portion of the knitted fabric 6 about the fresh winding shaft 8, the truck 102, on which the doffed fabric roll 6*a* has been placed, is displaced outside the knitting machine to a predetermined position as shown in FIG. 2. Thereafter the normal knitting operation is started again. However, the normal knitting operation can be started when the truck 102 is displaced outside the knitting machine. To displace the truck 102 to a stand-by position in the knitting machine for receiving a full size fabric roll 6*a* from the winding mechanism 7, the operation panel for actuating the transfer mechanism shown in FIG. 16 is manually operated.

As mentioned above, the truck 102 is returned into the knitting machine by the operation of the operation panel by the operator. However, it is possible to adopt an arrangement in which removal of the fabric roll 6*a* from the truck 102 and return of the truck 102 into the knitting machine can be performed automatically and the knitting device 3 and the winding mechanism 7 are started again after confirmation of the return of the truck 102.

As explained in the hereinbefore explanation concerning the construction of the winding shaft 8 with reference to FIGS. 19 to 23C, when winding shaft 8 is taken from the fabric roll 6*a*, the body shaft 132 is turned by turning the auxiliary square shell 137 relative to the square shell 135 so that the engaging clicks 142 are retracted from the fabric roll 6*a* into the square shell 135. Consequently, the winding shaft 8 can be smoothly taken from the fabric roll 6*a*.

According to the present invention, all the operations in the machine can be conducted automatically and an operator need not take the trouble of getting into the machine for the doffing of fabric rolls or the mounting of fresh winding shafts. Therefore, a remarkable amount of labor can be saved and it is possible to form large packages of knitted fabric rolls. Further, since the knitting device and winding device which have been kept stationary after completion of one cycle of the operation can be automatically started again, the knitting operation can be conducted with a high efficiency and the production rate can be remarkably enhanced.

What is claimed is:

1. An automatic apparatus for doffing fabric rolls formed on a winding shaft from a circular knitting machine provided with a frame means, horizontal supporting means rotatably mounted on said frame means about a rotation center thereof, a knitting device rigidly mounted on a part of said horizontal supporting means, a takeup mechanism rigidly supported by said horizontal supporting means at a position right below said knitting device and a winding mechanism rigidly supported by said horizontal supporting means at a position right below said takeup device, wherein said takeup mechanism and said winding mechanism are capable of turning about a common turning center corresponding to a rotational center of said knitting device; comprising:

means for detecting a condition that a predetermined length of knitted fabric has been wound on said winding shaft supported by said winding mechanism;

means for stopping said winding shaft supported by said winding mechanism together with said knitting device and said takeup device at a predetermined common angular position with respect to a common turning center of said takeup mechanism and winding mechanism which correspond to a rotational axis of said knitting device, when said detecting means detects said condition;

means for cutting said knitted fabric at a position between said takeup mechanism and a fabric roll formed on said winding shaft mounted on said winding mechanism;

means for supporting both ends of said winding shaft on said winding mechanism in such a condition that both ends of said winding shaft can be simultaneously released therefrom; and transferring means for receiving said fabric roll doffed from said winding mechanism below said frame means adjacent said predetermined angular position and for transporting said doffed fabric roll to a position outside of said circular knitting machine, said fabric roll being dropped onto said transferring means when said winding shaft ends are simultaneously released by said winding shaft supporting means.

2. An automatic apparatus for doffing fabric rolls formed on a winding shaft from a circular knitting machine according to claim 1, further comprising:

fresh winding shaft supplying means for carrying a fresh winding shaft to said winding mechanism and automatically detachably mounting said fresh winding shaft on said winding mechanism, and;

means for automatically fixing a free cut end portion of said knitted fabric, draped from said takeup mechanism, on said fresh winding shaft mounted on said winding mechanism.

3. An automatic apparatus for doffing fabric rolls, each of which is formed on a winding shaft from a circular knitting machine according to claim 1, wherein said cuttingmeans comprises a guide rail disposed at a position adjacent to said winding mechanism in such a condition that it extends along a supporting position of said winding shaft on said winding mechanism, a carrier including a first driving motor mounted for bidirectional linear movement on said guide rail, a second driving motor on said frame means, coupling means for connecting said second driving motor to said carrier to cause said linear movement in response to actuation of said second driving motor, a cutter mounted on said carrier and coupled to said first driving motor, whereby when electric power is provided to said driving motors, said carrier moves along said guide rail and said cutter is rotated so that said knitted fabric is automatically cut parallel to said winding shaft by said rotating cutter as said carrier moves along said guide rail.

4. An automatic apparatus for doffing fabric rolls, each of which is formed on a winding shaft from a circular knitting machine according to claim 1, wherein said supporting means for supporting both ends of said winding shaft on said winding mechanism comprises a pair of supporting members, each provided with a supporting bearing member, one of said bearing members being always connected to a driving mechanism of said winding mechanism.

5. An automatic apparatus for doffing fabric rolls, each of which is formed on a winding shaft from a circular knitting machine according to claim 1, wherein said detecting means comprises an automatic counter counting the number of revolutions of said knitting device about said rotation center, and said stop means comprises a switch means for actuating an electric control circuit for stopping the driving of said knitting device and takeup, winding mechanisms, said automatic counter counts a predetermined number of revolutions of said knitting device which indicates that a predetermined length of knitted fabric has been wound on said winding shaft, and said automatic counter issues a signal by which said switch means can be actuated.

6. An automatic apparatus for doffing fabric rolls, each of which is formed on a winding shaft from a circular knitting machine according to claim 2, wherein said fresh winding shaft supplying means comprises means for reserving a plurality of fresh winding shafts and means for transporting a fresh winding shaft from said reserving means to said automatic mounting means, said reserving means and said transporting means being disposed at position inside said circular knitting machine.

7. An automatic apparatus for doffing fabric rolls, each of which is formed on a winding shaft from a circular knitting machine according to claim 2, wherein said means for automatically fixing a cut end of said knitted fabric, draped from said takeup device, on a fresh winding shaft mounted on said winding mechanism comprises in combination, with said winding shaft provided with a plurality of engaging members mounted thereon in such a condition that said engaging members are capable of being projected outside from the outside face of said winding shaft and capable of being retracted into said winding shaft, and means for introducing said cut end portion of said knitted fabric draped from said takeup mechanism to a winding position of said winding mechanism.

8. An automatic apparatus for doffing fabric rolls, each of which is formed on a winding shaft from a circular knitting machine according to claim 4, wherein each of said supporting members is provided with a restraining member for facilitating the discharge of said full size fabric roll from said winding mechanism.

9. An automatic apparatus for doffing fabric rolls, each of which is formed on a winding shaft from a circular knitting machine according to claim 4, wherein said bearing members are capable of linear movement along a common axial direction thereof toward an outside direction of said winding shaft mounted on said winding mechanism when said full size fabric roll is released from said winding mechanism.

10. Apparatus according to claim 4, wherein said winding shaft supporting means includes a pair of supporting elements each having an inclined guide surface adjacent a respective one of said bearing members, said bearing members releasing said winding shaft when displaced away from the ends thereof, the released winding shaft rolling on said inclined guide surfaces and dropping onto said transferring means from the ends thereof, said transferring means being positioned beneath said ends of said inclined guide surfaces to accurately and safely receive the doffed fabric roll.

11. An automatic apparatus for doffing fabric rolls formed on a winding shaft from a circular knitting machine provided with a frame means, horizontal supporting means rotatably mounted on said frame means about a rotation center thereof, a knitting device rigidly mounted on a part of said horizontal supporting means, a takeup mechanism rigidly supported by said horizontal supporting means at a position right below said knitting device and a winding mechanism rigidly supported by said horizontal supporting means at a position right below said takeup device, wherein said takeup mechanism and said winding mechanism are capable of turning about a common turning center corresponding to a rotational center of said knitting device; comprising:

means for detecting a condition that a predetermined length of knitted fabric has been wound on said winding shaft supported by said winding mechanism;

means for stopping said winding shaft supported by said winding mechanism together with said knitting device and said takeup device at a predetermined common angular position with respect to a common turning center of said takeup mechanism and winding mechanism which corresponds to a rotational axis of said knitting device, when said detecting means detects said condition;

means for cutting said knitted fabric at a position between said takeup mechanism and a fabric roll formed on said winding shaft mounted on said winding mechanism;

means for supporting both ends of said winding shaft on said winding mechanism in such a condition that both ends of said winding shaft can be simultaneously released therefrom;

transferring means for receiving said fabric roll doffed from said winding mechanism and for transporting said doffed fabric roll to a position outside of said circular knitting machine; and an electricity feeder mounted on said frame means and a current collector mounted on said horizontal supporting means in such a condition that when said takeup mechanism and winding mechanism are stopped at said predetermined common angular position, said current collector is capable of receiving electric power from said electricity feeder and of supplying electric power to said cutting means.

12. An automatic apparatus for doffing fabric rolls formed on a winding shaft from a circular knitting machine provided with a frame means, horizontal supporting means rotatably mounted on said frame means about a rotation center thereof, a knitting device rigidly mounted on a part of said horizontal supporting means at a position right below said takeup device, wherein said takeup mechanism and said winding mechanism are capable of turning about a common turning center corresponding to a rotational center of said knitting device; comprising:

means for detecting a condition that a predetermined length of knitted fabric has been wound on said winding shaft supported by said winding mechanism means for stopping said winding shaft supported by said winding mechanism together with said knitting device and said takeup device at a predetermined common angular position with respect to a common turning center of said takeup mechanism and winding mechanism which corresponds to a rotational axis of said knitting device, when said detecting means detects said condition;

means for cutting said knitted fabric at a position between said takeup mechanism and a fabric roll formed on said winding shaft mounted on said winding mechanism;

means for supporting both ends of said winding shaft on said winding mechanism in such a condition that both ends of said winding shaft can be simultaneously released therefrom; and transferring means for receiving said fabric roll doffed from said winding mechanism and for transporting said doffed fabric roll to a position outside of said circular knitting machine, said transferring means comprising a vertical pillar rigidly supported by said frame means and a truck turnably supported by said pillar in such condition that said truck is capable of moving from a receiving position right below said winding mechanism to a position outside said circular knitting machine, said truck being provided with a receiving plate for stably receiving a full size fabric roll discharged from said winding mechanism.

13. An automatic apparatus for doffing fabric rolls, each of which is formed on a winding shaft from a circular knitting machine according to claim 12, further comprising an auxiliary means for permitting free passage of said truck through said frame means of said circular knitting machine when said truck moves from said receiving position to said outside position and vice versa.

14. An automatic apparatus for doffing fabric rolls, each of which is formed on a winding shaft from a circular knitting machine according to claim 12, wherein said receiving plate of said truck is provided with a V-shaped recess which is capable of stably receiving a full size fabric roll.

15. An automatic apparatus for doffing fabric rolls, each of which is formed on a winding shaft from a circular knitting machine according to claim 12, wherein said truck comprises a base member whereon said receiving plate is displaceably mounted.

16. An automatic apparatus for doffing fabric rolls, each of which is formed on a winding shaft from a circular knitting machine according to claim 15, wherein said truck is divided into a driving stand and a driven stand connected to each other through a connecting member, whereby said truck is capable of being vertically bent at this connecting position, and said receiving plate is displaceably mounted on said driven stand while said driving stand is turnably supported by said vertical pillar.

17. In a circular knitting machine provided with a knitting device and a takeup mechanism disposed at a position right below said knitting device and a winding mechanism disposed at a position right below said takeup mechanism and means for transferring a fabric roll doffed from said winding mechanism, said takeup mechanism and said winding mechanism being capable of turning about a common turning center corresponding to a rotation axis of said knitting device, said winding mechanism being capable of detachably supporting a winding shaft whereon said fabric roll is formed, a method for doffing fabric rolls formed on said winding shaft from said knitting machine comprising the successive steps in the sequence of:

detecting a condition that a predetermined length of knitted fabric delivered from said takeup mechanism has been wound on said winding shaft detachably supported by said winding mechanism;

reducing the driving speed of said knitting machine;

after a predetermined time of reducing the driving speed of said knitting machine to a predetermined reduced driving speed from a time of detecting that a predetermined length of knitted fabric has been wound on said winding shaft, stopping said takeup mechanism and said winding mechanism at a predetermined common angular position with respect to a common turning center thereof;

cutting said knitted fabric at a position between said takeup mechanism and said fabric roll;

simultaneously releasing both ends of said winding shaft, whereon said fabric roll has been formed, from said winding mechanism, and allowing said fabric roll to fall together with said winding shaft on said transferring means positioned at a standby position below said winding mechanism stopped at said predetermined common angular position; and transporting said doffing fabric roll together with said winding shaft by displacing said transferring means from said standby position of said transferring means to a position outside of said circular knitting machine.

* * * * *

UNITED STATES PATENT OFFICE

CERTIFICATE OF CORRECTION

Patent No. 4,079,600 Dated March 21, 1978

Inventor(s) Yukio Amaya, et al

It is certified that error appears in the above-identified patent and that said Letters Patent are hereby corrected as shown below:

Column 1, line 58: "with" should be --the--.

Column 4, line 1: "utilizing" should be --utilized--.

line 61: "whereupon" should be --whereon--.

Column 8, line 35: "(respectively" should be --respectively (--

Column 9, line 28: "balde" should be --blade--.

line 64: "A" should be --An--.

line 67: "circumferencial" should be --circumferential--.

Column 10, line 2: "proove" should be --groove--.

Column 11, line 46: After "understanding" insert --of--.

Column 13, line 46: After "that" insert --they--.

UNITED STATES PATENT OFFICE

CERTIFICATE OF CORRECTION

Patent No. 4,079,600 Dated March 21, 1978

Inventor(s) Yukio Amaya, et al

It is certified that error appears in the above-identified patent and that said Letters Patent are hereby corrected as shown below:

Column 14, line 46: Delete "for".

line 47: Before "sensing" insert --for--.

Column 21, line 21: "21" should be --12--.

Column 24, line 24: "cuttingmeans" should be --cutting means--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*